US008181788B2

(12) United States Patent
Meneses

(10) Patent No.: US 8,181,788 B2
(45) Date of Patent: May 22, 2012

(54) RECLOSEABLE, FOLDING CONTAINER AND BLANKS AND METHOD OF MANUFACTURING

(75) Inventor: Aaron Meneses, Whittier, CA (US)

(73) Assignee: Belkin International Inc., Playa Vista, CA (US)

( * ) Notice: Subject to any disclaimer, the term of this patent is extended or adjusted under 35 U.S.C. 154(b) by 59 days.

(21) Appl. No.: 12/713,155

(22) Filed: Feb. 25, 2010

(65) Prior Publication Data

US 2010/0213099 A1 Aug. 26, 2010

Related U.S. Application Data

(60) Provisional application No. 61/155,463, filed on Feb. 25, 2009.

(51) Int. Cl.
*B65D 5/50* (2006.01)

(52) U.S. Cl. ..... 206/765; 206/756; 206/769; 206/776

(58) Field of Classification Search ..... 206/756, 206/764, 765, 277, 301, 775, 779, 461, 778, 206/776, 531, 532, 769, 770, 774
See application file for complete search history.

(56) References Cited

U.S. PATENT DOCUMENTS

| | | | | | |
|---|---|---|---|---|---|
| 3,159,273 | A * | 12/1964 | Schecterson et al. | ..... | 206/761 |
| 4,840,275 | A * | 6/1989 | Faiola et al. | ..... | 206/423 |
| 4,869,368 | A * | 9/1989 | Hara | ..... | 206/455 |
| 5,076,432 | A * | 12/1991 | Wolf et al. | ..... | 206/449 |
| 5,433,316 | A * | 7/1995 | McQueeny | ..... | 206/232 |
| 5,636,746 | A * | 6/1997 | McQueeny | ..... | 206/756 |
| 5,823,352 | A * | 10/1998 | Mena et al. | ..... | 206/721 |
| 6,527,123 | B1 * | 3/2003 | Ausaf | ..... | 206/549 |
| 7,025,207 | B2 * | 4/2006 | Breu et al. | ..... | 206/531 |
| 7,748,534 | B2 * | 7/2010 | Jeannin et al. | ..... | 206/528 |
| 2002/0104777 | A1 * | 8/2002 | Robley, Jr. | ..... | 206/764 |
| 2005/0051461 | A1 * | 3/2005 | Bryant | ..... | 206/769 |
| 2005/0173291 | A1 * | 8/2005 | Specker et al. | ..... | 206/536 |
| 2005/0284782 | A1 * | 12/2005 | Nago | ..... | 206/315.11 |

* cited by examiner

*Primary Examiner* — David Fidei
(74) *Attorney, Agent, or Firm* — Bryan Cave LLP

(57) ABSTRACT

Some embodiments disclose a folding box configured to hold a product. The folding box can include: (a) an enclosure base configured to form a cavity and having: (1) a first back panel; (2) a first left-side panel; (3) a first right-side panel; (4) a first bottom panel; and (5) a first top panel; (b) an enclosure door coupled to the enclosure base, the enclosure door having: (1) a front panel having a second top panel; (2) a second left-side panel; (3) a second right-side panel; and (4) a second bottom panel; (c) a box insert blank configured to be received within and fixedly attached within the cavity of the enclosure base and comprising a second back panel; and (d) a product mounting blank configured to receive the product and configured to be fixedly attach to the box insert blank. A portion of the second top panel of the enclosure door can be hingedly coupled to a portion of the first top panel of the enclosure base such that the enclosure door can be moved between a first position, in which the enclosure base and the enclosure door substantially enclose the cavity, and a second position, in which the cavity is exposed. The front panel, the second left-side panel, the second right-side panel, and the second bottom panel can be configured to enclose the enclosure base when the enclosure door is in the first position. Other embodiments are disclosed herein.

22 Claims, 14 Drawing Sheets

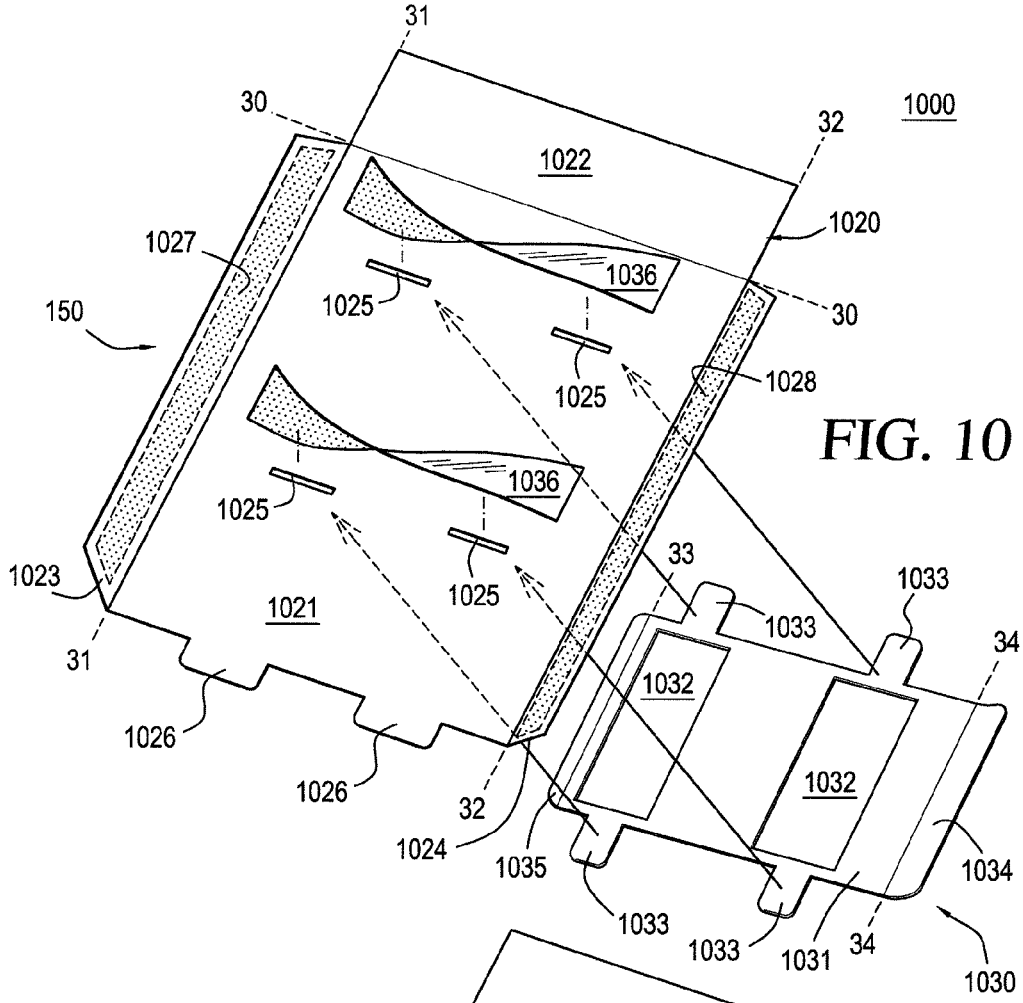
FIG. 10
FIG. 11
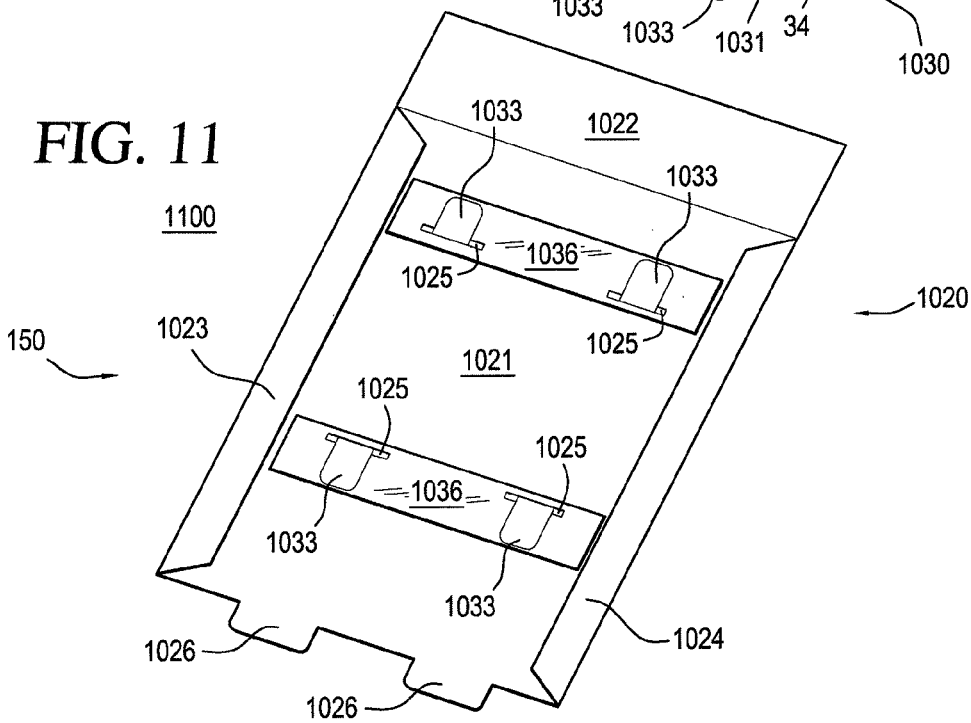

1400

RECLOSEABLE, FOLDING CONTAINER AND BLANKS AND METHOD OF MANUFACTURING

CROSS-REFERENCE TO RELATED APPLICATIONS

This application claims the benefit of U.S. Provisional Application No. 61/155,463, filed Feb. 25, 2009. U.S. Provisional Application No. 61/155,463 is incorporated herein by reference.

FIELD OF THE INVENTION

The invention generally relates to a display and packaging apparatus for packaging and displaying merchandise. More particularly, the invention relates to a blank for a foldable display enclosure having integral carrying mechanisms and visual and tactile display mechanisms.

BACKGROUND OF THE INVENTION

Conventional packaging enclosures are used in many different applications and can provide security for product(s) contained in the enclosures by providing physical protection for the products and barrier protection for the products. Additionally, packaging enclosures can be used for marketing, for providing information about the products, and for convenience (e.g., facilitating stacking, display, sale, opening, reclosing, use, dispensing, and reuse) and the like.

Typically, packaging enclosures are manufactured as a foldable blank from one or more foldable materials, such as cardstock, paperboard, chipboard and the like, which allow the foldable blank to be produced to the manufacturer's desires for protection, display and security of the contents. Unfortunately, packaging enclosures designed for protection of the contents within the enclosure can hinder the display of the contents within the enclosure. In other words, designs of packaging enclosures focused toward protection of the contents and security of the contents tend to detract from display of the contents.

Display of the contents can be categorized as visual display and tactile display (e.g., allowing a user to touch an enclosed product). To that end, while designs focused on protection of the contents and security of the contents can detract from visual display, tactile display is an anathema to protection and security of the contents. Thus, packaging enclosures that provide stronger security of the contents limit contact, if any contact is permitted at all, of the contents or product by the consumers while the product is in the packaging enclosure.

Accordingly, to improve the customer's experience of buying a product, a need exists for a packaging enclosure enhancing visual display and tactile display of contents of the enclosure while providing security from theft for the contents.

BRIEF DESCRIPTION OF THE DRAWINGS

The invention will be better understood from a reading of the following detailed description of examples of embodiments, taken in conjunction with the accompanying figures in the drawings in which:

FIG. 10 illustrates a product mounting blank and a box insert blank for mounting within the exemplary package enclosure blank of FIG. 9, according to an embodiment of the subject matter described herein;

FIG. 11 illustrates the box insert blank of FIG. 10 after folding a portion of the box insert blank of FIG. 10 and inserting it into and securing it to the product mounting blank of FIG. 10 to form a product display system, according to an embodiment of the subject matter described herein;

Figure 1:
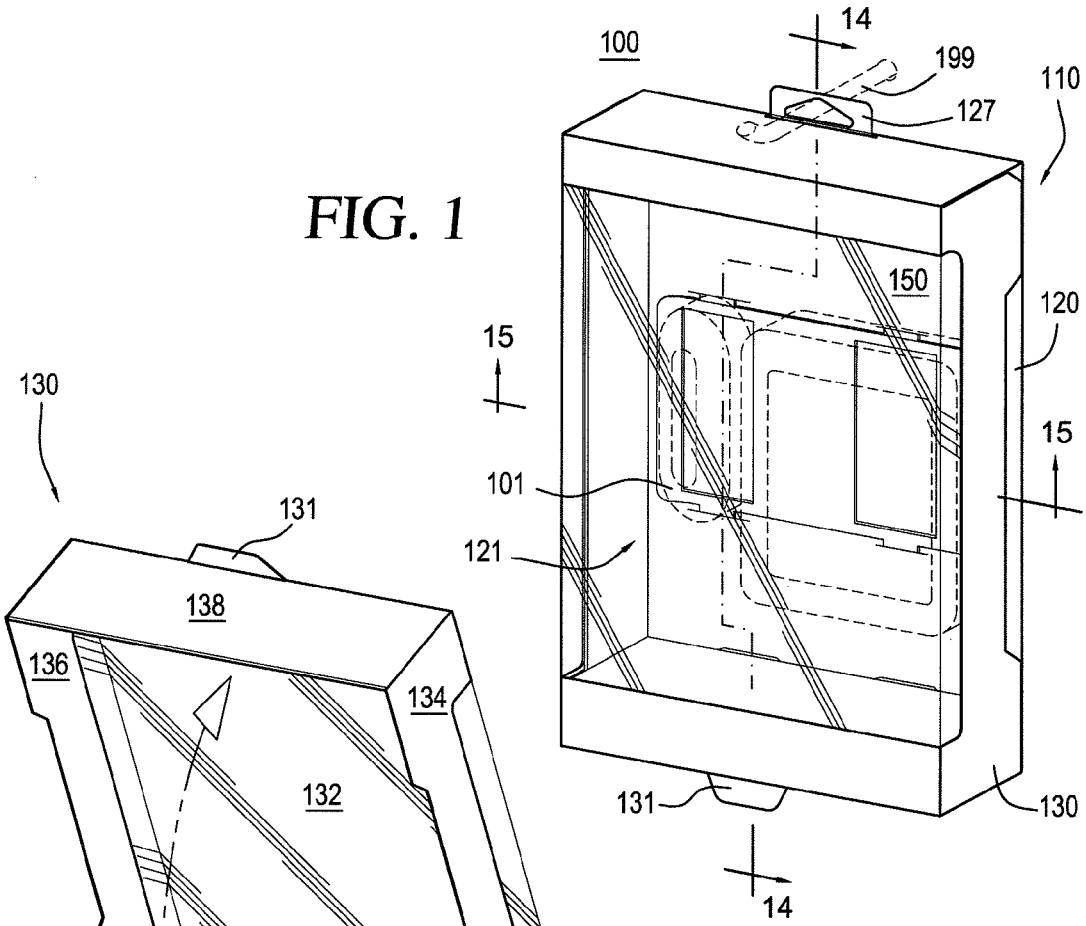
FIG. 1 is a three-quarter front view illustrating a packaging system including a closed exemplary package enclosure as well as an exemplary product display and a product secured to the exemplary product display, according to an embodiment of the subject matter described herein.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of examples of embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "couple," "coupled," "couples," "coupling," and the like should be broadly understood and refer to connecting two or more elements, mechanically and/or otherwise. For example, two or more mechanical elements may be mechanically coupled, but not be electrically or otherwise coupled. Coupling may be for any length of time, e.g., permanent or semi-permanent or only for an instant. "Mechanical coupling" and the like should be broadly understood and include mechanical coupling of all types. The absence of the word "removably," "removable," and the like near the word "coupled," and the like does not mean that the coupling, etc. in question is or is not removable.

DETAILED DESCRIPTION OF EXAMPLES OF EMBODIMENTS

Some embodiments disclose a folding box configured to hold a product. The folding box can include: (a) an enclosure base configured to form a cavity and having: (1) a first back panel; (2) a first left-side panel; (3) a first right-side panel; (4) a first bottom panel; and (5) a first top panel; (b) an enclosure door coupled to the enclosure base, the enclosure door having: (1) a front panel having a second top panel; (2) a second left-side panel; (3) a second right-side panel; and (4) a second bottom panel; (c) a box insert blank configured to be received within and fixedly attached within the cavity of the enclosure base and comprising a second back panel; and (d) a product mounting blank configured to receive the product and configured to be fixedly attach to the box insert blank. A portion of the second top panel of the enclosure door can be hingedly coupled to a portion of the first top panel of the enclosure base such that the enclosure door can be moved between a first position, in which the enclosure base and the enclosure door substantially enclose the cavity, and a second position, in which the cavity is exposed. The front panel, the second left-side panel, the second right-side panel, and the second bottom panel can be configured to enclose the enclosure base when the enclosure door is in the first position.

In the same or different embodiments, a package system can be configured to hold a product. The package system can include: (a) a two-piece product display, the product display configured to receive the product; and (b) a package enclosure, the package enclosure including an enclosure base configured to receive the product display, the package enclosure additionally including an enclosure door hingedly coupled to the enclosure base, the enclosure door when in a closed position is configured to mate to the enclosure base to enclose the product. The two-piece product display can include: (a) a box insert blank, the box insert blank configured to be received within and fixedly attached within the enclosure base; and (b) a product mounting blank, the product mounting blank configured to receive the product, the product mounting blank further configured to fixedly attach to the box insert blank.

Still further embodiments disclose a method of method of manufacturing a packaging enclosure. The method can include: providing a package enclosure blank having a package enclosure door and a package enclosure base; scoring fold lines at one or more locations on the package enclosure blank; applying adhesive to one or more first portions of the package enclosure blank; applying a film to a front panel of the package enclosure door of the package enclosure blank; assembling the enclosure door portion of the package enclosure blank; assembling the enclosure base portion of the package enclosure blank; assembling a two-piece product display, assembling the two-piece product display can include: affixing a product to a product mounting blank; and mounting the product mounting blank to a box insert blank; and mounting a two-piece product display to the enclosure base portion of the package enclosure base.

Turning to the drawings, FIG. 1 is a three-quarter front view illustrating a packaging system 100 including a closed exemplary package enclosure 110 as well as an exemplary product display 150 (in dashed lines) and a product 101 (in dashed lines) of one or more products secured to exemplary product display 150. Embodiments of packaging system 100 can provide improved customer interaction characteristics over the prior art. Packaging system 100 is merely exemplary and is not limited to the embodiments presented herein. Packaging system 100 can be employed in many different embodiments or examples not specifically depicted or described herein. Packaging system 100 allows for a customer to view the contents within package enclosure 110. In FIG. 1, exemplary packaging system 100 can also include other elements not relevant to the present discussion.

Package enclosure 110 can include an enclosure base 120 and an enclosure door 130. As shown in FIG. 1, enclosure base 120 defines a cavity 121 within package enclosure 110 for receiving exemplary product display 150 and product 101. Cavity 121 can have an opening along the front side of package enclosure 110, and enclosure door 130 is configured to selectively or conformally cover the opening of cavity 121. That is, enclosure door 130 can be hingedly coupled to a enclosure base 120 such that enclosure door 130 can be moved between a closed position, in which enclosure base 120 and enclosure door 130 substantially enclose the cavity 121, and an open position, in which cavity 121 is exposed.

In some embodiments, enclosure door 130 includes a see-through front panel allowing a customer to see product 101 contained within cavity 121 when package enclosure 110 is closed as depicted in FIG. 1.

In other embodiments, enclosure door 130 includes an enclosure door tab 131 configured to extend from a portion of enclosure door 130. For example, an enclosure door tab 131 can be formed from material along the bottom front edge of enclosure door 130. Enclosure door tab 131 can assist a customer in selectively manipulating enclosure door 130 to cover or not cover cavity 121. In still other embodiments, enclosure base 120 includes a hanger 127 affixed to enclosure base 120, such as, for example along the top of enclosure base 120, allowing package enclosure 110 to be hung from one or more merchandising display hooks 199. Enclosure base 120 and enclosure door 130 are described in more detail below.

In FIG. 1, exemplary product display 150 and product 101 are located within cavity 121 within package enclosure 110. In some embodiments, exemplary product display 150 is affixed to an interior wall, associated with cavity 121 defined by enclosure base 120, within package enclosure 110. In other embodiments, product 101 is affixed to exemplary product display 150. Exemplary product display 150 and product 101 are described in more detail below.

Figure 2:
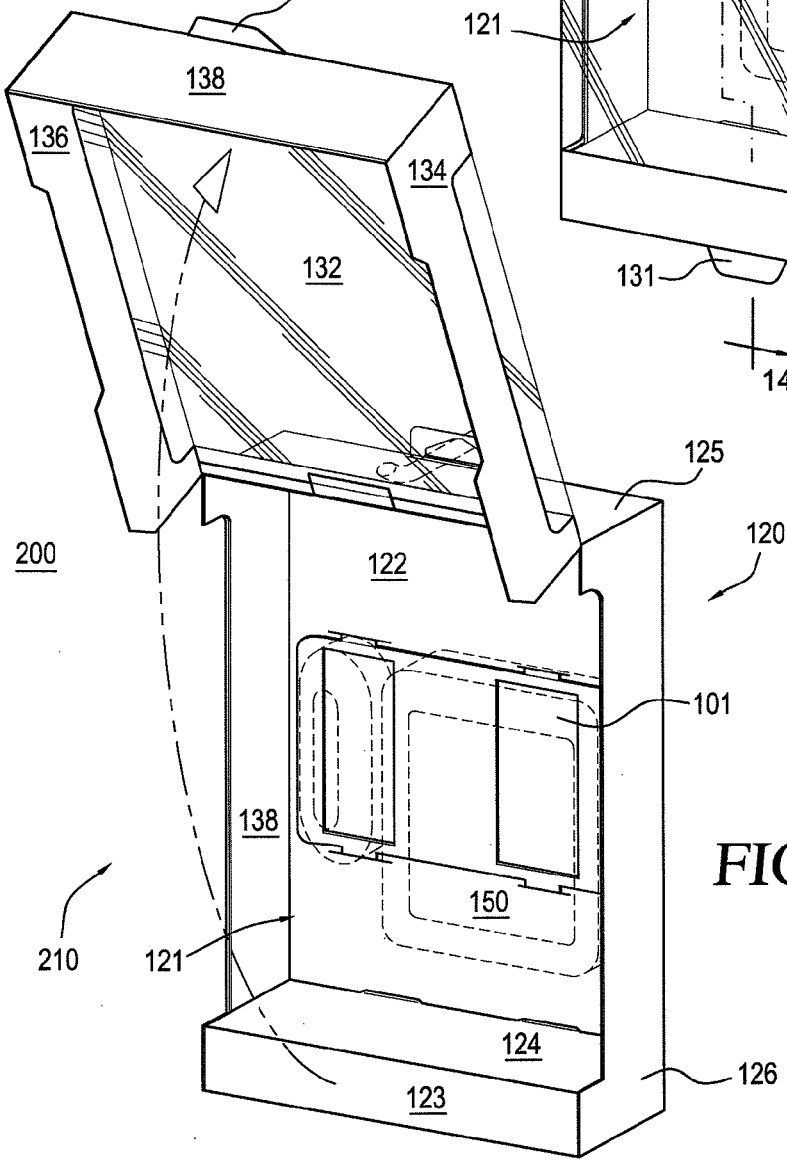
FIG. 2 is a three-quarter front view illustrating a packaging system including an open exemplary package enclosure as well as an exemplary product display and a product secured to the exemplary product display, according to an embodiment of the subject matter described herein.

FIG. 2 is a three-quarter front view illustrating a packaging system 200 including an open exemplary package enclosure 210 as well as an exemplary product display 150 (in dashed lines) and a product 101 (in dashed lines) secured to exemplary product display 150. Packaging system 200 is merely exemplary and is not limited to the embodiments presented herein. Packaging system 200 can be employed in many different embodiments or examples not specifically depicted or described herein. Packaging system 200 can be similar to packaging system 100 in FIG. 1.

Open exemplary package enclosure 210 includes enclosure base 120 and enclosure door 130. Packaging system 200 illustrates an assembled package enclosure in the open position containing exemplary product display 150 and a product 101. When packaging system 200 is in the open position, packaging system 200 allows a customer to visually and tactilely interact with the contents within package enclosure 110. In FIG. 2, exemplary packaging system 200 may include other elements not relevant to the present discussion.

In FIG. 2, enclosure base 120 can include: (a) a back panel 122; (b) right side panel 126; (c) left side panel 128; (d) a top panel 125; (e) a bottom interior panel 124; and (f) a bottom exterior panel 123. Back panel 122, right side panel 126, left side panel 128, top panel 125 and bottom interior panel 124 each have an internal portion and an external portion and are mechanically coupled together to form cavity 121, which is defined by the interior portion of the panels. Furthermore, exemplary product display 150 and product 101 are received in cavity 121 formed by the panels. In some embodiments, enclosure base 120 is manufactured from a single piece of material with each interior edge of the associated panel configured to be folded and/or affixed to another portion of enclosure base 120 to form cavity 121.

In FIG. 2, enclosure door 130 can include: (a) a front panel 132; (b) a left-side panel 136; (c) a right-side panel 134; and (d) lower panel 138. Front panel 132, left-side panel 136, right-side panel 134, and lower panel 138 each have an internal portion and an external portion and are mechanically coupled at an associated edge to form a cover for cavity 121 when packaging system 200 is in a closed position. When enclosure door 130 is positioned to cover cavity 121 (i.e., in a closed position), it will also enclose exemplary product display 150 and a product 101 if those elements are contained within cavity 121. In some embodiments, enclosure door 130 is manufactured from a single piece of material with each interior edge of the associated panel configured to be folded and/or affixed to another portion of enclosure door 130 to a cover for cavity 121.

In one embodiment as detailed below, enclosure door 130 is configured to fit around and otherwise enclose associated portions of enclosure base 120, such as, for example, the interior portions of left and right side panels 136 and 134 are configured to fit around the exterior portions of associated left and right side panels 128 and 126, respectively, and the interior portion of lower panel 138 is configured to fit around the exterior portion of associated bottom exterior panel 123.

Figure 3:
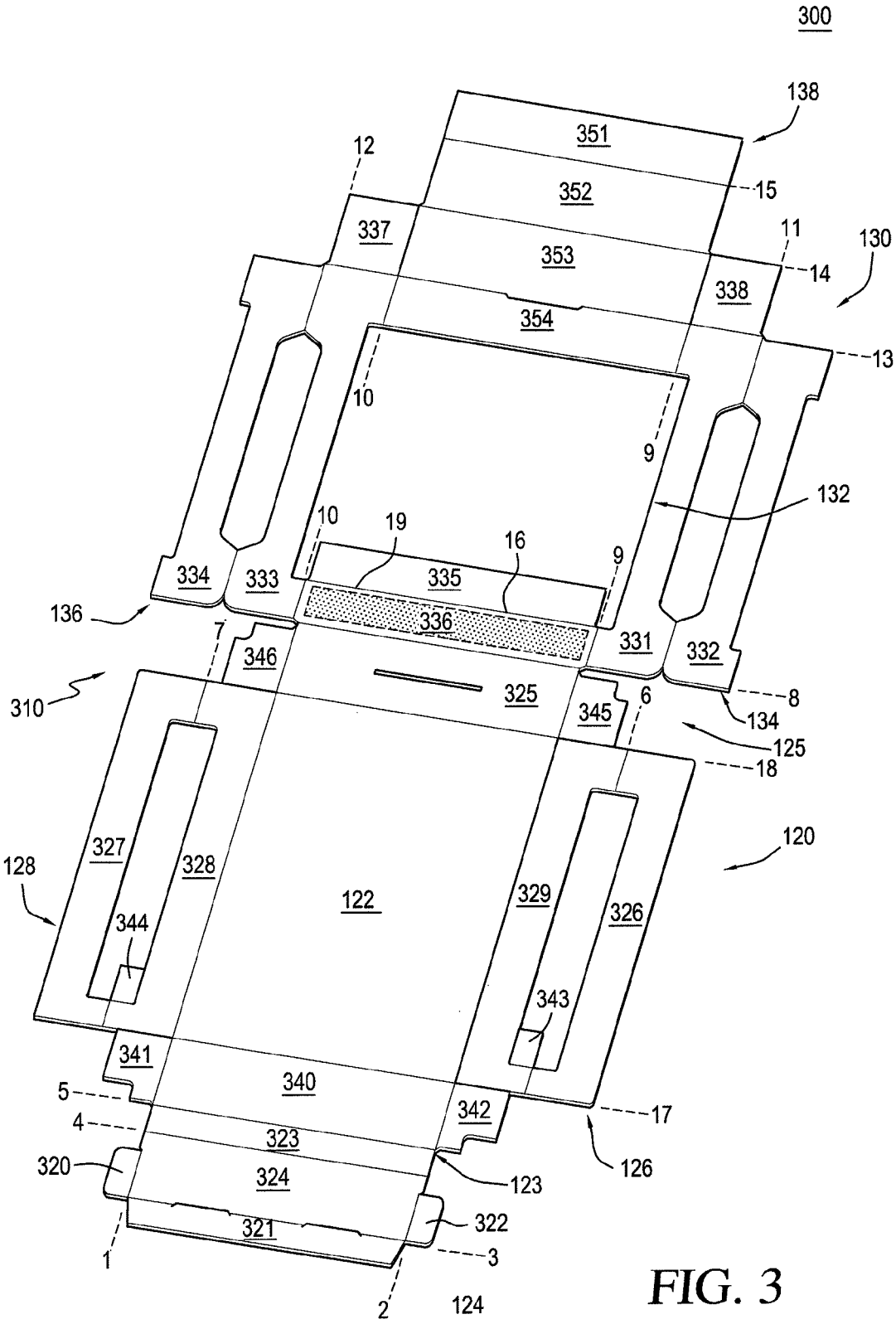
FIG. 3 is a perspective view illustrating an examplary package enclosure blank with an exemplary adhesive strip, all of an examplary package system, according to an embodiment of the subject matter described herein.

FIG. 3 is a perspective view illustrating an exemplary packaging system 300 with an exemplary adhesive strip 336. Packaging system 100 is merely exemplary and is not limited to the embodiments presented herein. Packaging system 100 can be employed in many different embodiments or examples not specifically depicted or described herein. Packaging system 300 can be similar to packaging systems 100 and 200 in FIGS. 1 and 2, respectively.

As shown in FIG. 3, packaging system 300 includes an exemplary folding box blank or package enclosure blank 310. Exemplary package enclosure blank 310 can include enclosure base 120 and enclosure door 130. Enclosure base 120 includes back panel 122, right side panel 126, left side panel 128, top panel 125, bottom interior panel 124, and a bottom exterior panel 123. Enclosure door 130 includes front panel 132, left-side panel 136, right-side panel 134, and lower panel 138. Elements similarly numbered and described in FIGS. 1 and 2 function in a substantially similar way. In some embodiments, panels 321, 323, 324, 325, and 340 are configured in a substantially rectangular configuration. In FIG. 3, packaging system 300 may include other elements not relevant to the present discussion.

In FIG. 3, bottom exterior panel 123 can include: (a) panels 323 and 340; and (b) tabs 341 and 342. Bottom interior panel 124 can include: (a) panels 321 and 324; and (b) tabs 320 and 322. Right side panel 126 can include: (a) panels 326 and 329; and (b) tab 343. Left side panel 128 can include: (a) panels 327 and 328; and (b) tab 344. Top panel 125 can include: (a) panel 325; and (b) tabs 345 and 346.

In FIG. 3, front panel 132 can include top panels 335 and 354. In the example illustrated in FIG. 3, a portion of top panel 335 is overlaid with an adhesive strip 336 (i.e., an affixing compound, such as, for example a glue compound suitable for affixing one panel to another). Left side panel 136 can include: (a) panels 333 and 334; and (b) tab 337. Right side panel 134 can include: (a) panels 331 and 332; and (b) tab 338. Lower panel 138 can include panels 351, 352, 353, and 354. In some examples, tabs 337 and 338 can be considered part of lower panel 138. In some embodiments, panels 335, 351, 352, and 353 are configured in a substantially rectangular shape.

Back panel 122 is formed by folding a left-side edge, a right-side edge, a bottom edge, and a top edge of back panel 122 along folds 1, 2, 17, and 18, respectively.

Panel 321 is partially formed by folding a bottom edge of panel 324 of bottom interior panel 124 and an upper edge of panel 321 along fold 3. In some embodiments, a bottom edge of panel 324 and an upper edge of panel 321 can include slots configured to produce small tabs or receive tabs. Panel 324 is formed by folding an upper edge of panel 324 and a bottom edge of panel 323 of bottom exterior panel 123 along fold 4. Tab 320 is formed by folding along a left-side edge of panel 324 along fold 1, and tab 322 is formed by folding along a right-side edge of panel 324 along fold 2. The use of tabs 320 and 322 will be further detailed below.

Panel 323 is formed by folding an upper edge of panel 323 and a bottom edge of panel 340 along fold 5. Panel 340 is formed by folding an upper edge of panel 340 and the bottom edge of panel 122 along fold 17. Tab 341 is partially formed by folding a left-side edge of panel 340 along fold 1. In a different embodiment, tab 341 can be partially formed by folding a bottom edge of panel 328 of left side panel 128 along fold 17.

Tab 342 is formed by folding a right-side edge of panel 340 along fold 2. In a different embodiment, tab 342 can be formed by folding a bottom edge of panel 329 of right-side panel 126 along fold 17. Use of tabs 341 and 342 will be further detailed below.

Panel 327 of left-side panel 128 is formed by folding a left-side edge of panel 328 of left-side panel 128 along fold 7.

Panel 328 of left-side panel 128 is formed folding a right-side edge of panel 328 and the left-side edge of panel 122 along fold 1. Panels 327 and 328 share an associated edge formed by fold 7 (an interior edge). In some embodiments, a portion of each panel's associated edge has been removed resulting in a substantially rectangular gap between the panels as well as each panel having an interior edge. Tab 344 is formed within the substantially rectangular gap between panels 327 and 328 and configured to have a right-side edge along the longer side of the rectangle formed along the interior edge of panel 328 and a bottom edge along the shorter side of the rectangle formed along the interior edge of panel 328. In one embodiment, tab 344 is configured in a substantially rectangular shape with a height of about twenty percent (20%) of the length of the long edge of the substantially rectangular gap between panels 327 and 328. Additionally, tab 344 can have a width of about fifty percent (50%) of the length of the short edge of the substantially rectangular gap between panels 327 and 328. Usage of tab 344 will be detailed below.

Panel 326 of right-side panel 126 is formed by folding a right-side edge of panel 329 of right-side panel 126 along fold 6. Panel 329 of right-side panel 126 is formed by folding a left-side edge of panel 329 and the right-side edge of panel 122 along fold 2. Panels 326 and 329 share an associated edge formed by fold 7 (an interior edge). In some embodiments, a portion of each panel's associated edge has been removed resulting in a substantially rectangular gap between the panels as well as each panel having an interior edge. Tab 343 is formed within the substantially rectangular gap between panels 327 and 328 and configured to have a left-side edge along the longer side of the rectangle formed along the interior edge of panel 329 and a bottom edge along the shorter side of the rectangle formed along the interior edge of panel 329. In one embodiment, tab 343 is configured in a substantially rectangular shape with a height of about twenty percent (20%) of the length of the long edge of the substantially rectangular gap between panels 326 and 329. Additionally, tab 343 can have a width of about fifty percent (50%) of the length of the short edge of the substantially rectangular gap between panels 326 and 329. Usage of tab 343 will be detailed below.

Panel 325 of top panel 125 is formed by folding a left-side edge, a right-side edge, a top edge, and a bottom edge of panel 325 along folds 1, 2, 8, and 18, respectively. Tab 346 is formed by folding a left-side edge of panel 325 along fold 1. In a different embodiment, tab 346 is formed by folding along a top edge of panel 328 along fold 18. Tab 345 is formed by folding a right-side edge of panel 325 along fold 2. In a different embodiment, tab 345 is formed by folding a top edge of panel 329 along fold 18. Usage of tabs 345 and 346 will be detailed below.

Front panel 132 is formed by folding a bottom edge, a right-side edge, a left-side edge, and a top edge of front panel 132 along folds 8, 9, 10 and 13, respectively. Front panel 132 additionally includes a viewing portion removed from the center of front panel 132 and configured to allow a user to see through to a portion of back panel 122. In some embodiments, the viewing portion of front panel 132 is configured in a substantially rectangular shape.

Panel 351 and panel 352 are partially formed by folding a bottom edge of panel 351 and a top edge of panel 352 of lower panel 138 along fold 15. Panel 352 and panel 353 are partially formed by folding a bottom edge of panel 352 and a top edge of panel 353 of lower panel 138 along fold 14. Panel 353 and panel 354 are partially formed by folding a bottom edge of panel 353 and a top edge of panel 354 of front panel 132 along fold 13. In some embodiments, a bottom edge of panel 353 includes at least one slot along fold 13. The slot is configured to produce at least one small tab or to receive at least one tab. In an example, a bottom edge of panel 353 includes a slot configured to produce an enclosure door tab 131 (FIGS. 1 and 2). In this example, enclosure door tab 131 is configured to protrude downward from enclosure door 130 and is further configured to allow a user to open and close enclosure door 130, and thus, provide visual and tactile access to a product within package enclosure blank 310.

Panel 354 is partially formed by folding along a left and right edge of panel 354 along folds 10 and 9, respectively.

In FIG. 3, top panel 335 of front panel 132 is formed by fold 8 along a bottom edge of top panel 335, and the top portion of top panel 335 is temporarily configured to extend into the bottom portion of front panel 132. Additionally, adhesive strip 336 is configured to be deployed in sufficient quantities and onto a bottom portion of top panel 335 that does not extend into the bottom portion of front panel 132 or a top portion of top panel 335. Top panel 335 is further configured such that when the top portion of top panel 335 is folded along fold 19, the top portion of top panel 335 and adhesive strip 336 contact one another and adhere to one another thereby causing the top portion of top panel 335 to be positioned on top of adhesive strip 336 and thereby causing the top portion of top panel 335 to no longer extend into the bottom portion of front panel 132. In some embodiments, top panel 335 is configured in a substantially rectangular configuration.

Panel 334 and panel 333 are at least partially formed by folding a left-side edge of panel 333 of left-side panel 136 along fold 12. Panel 333 is partially formed by folding along a right-side edge of panel 333 and the left-side edge of front panel 132 along fold 10. Panels 333 and 334 share an associated edge formed by fold 12 (an interior edge). In some embodiments, a portion of each panel's associated edge has been removed resulting in a gap with substantially rounded ends between the panels as well as each panel having an interior edge. Tab 337 is formed by folding a bottom edge of tab 337 along fold 13. In another embodiment, tab 337 is formed by folding a left-side edge of panel 353 along fold 10. Use of tab 337 will be detailed below.

Panel 331 and 332 are at least partially formed by folding a right-side edge of panel 331 of right-side panel 134 along fold 11. Panel 331 is partially formed by folding a left-side edge of panel 331 and the right-side edge of front panel 132 along fold 9. Panels 331 and 332 share an associated edge formed by fold 11 (an interior edge). In some embodiments, a portion of each panel's associated edge has been removed resulting in a gap with substantially rounded ends between the panels as well as each panel having an interior edge. Tab 338 is formed by folding a bottom edge of tab 338 along fold 13. In another embodiment, tab 338 is formed by folding a right-side edge of panel 353 along fold 9. Use of tab 338 will be further detailed below.

Figure 4:
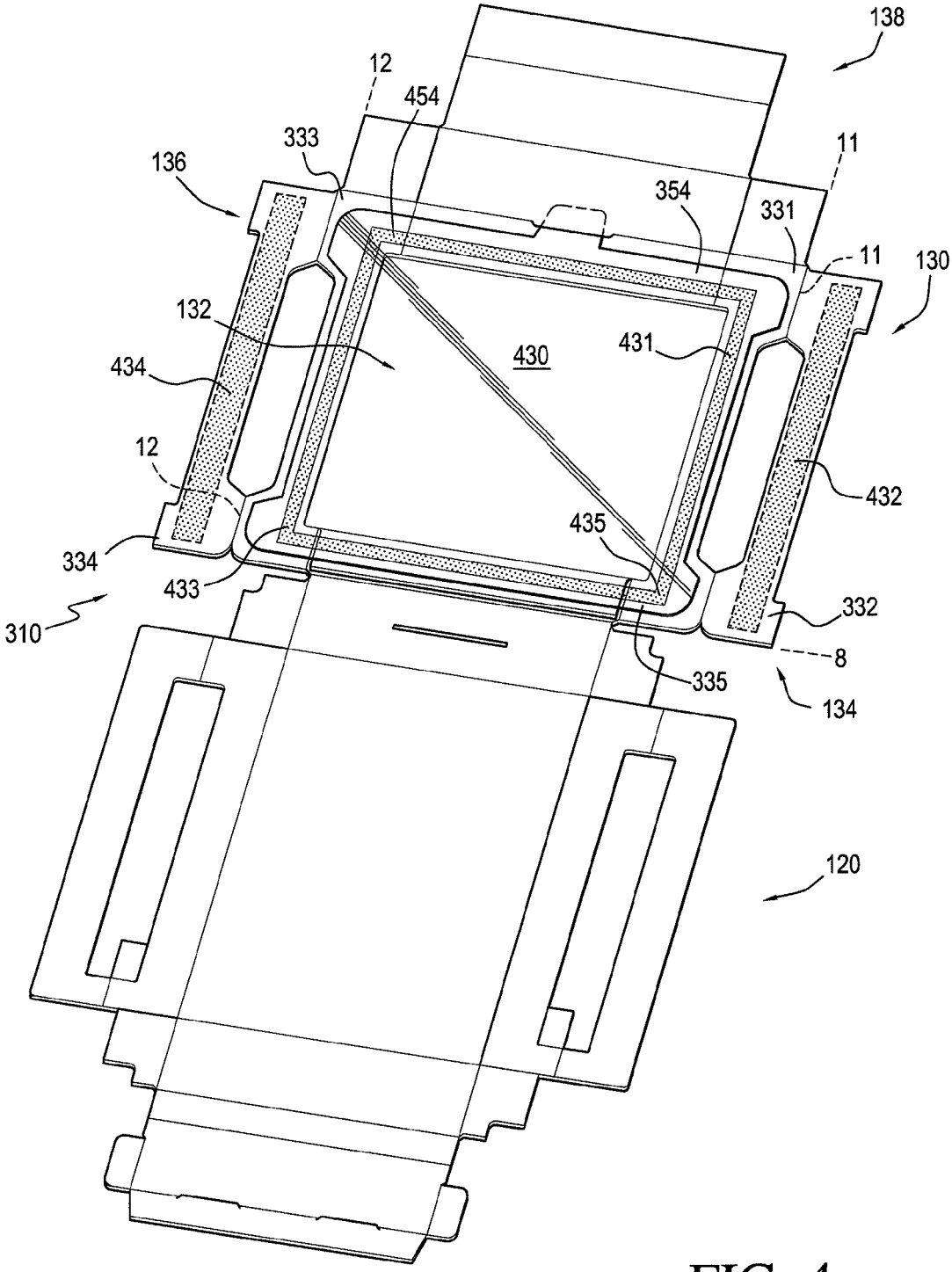
FIG. 4 is a perspective view that illustrates the exemplary package enclosure blank of FIG. 3 with additional adhesive strips, according to an embodiment of the subject matter described herein.

FIG. 4 is a perspective view that illustrates exemplary package enclosure blank 310 with additional adhesive strips. Exemplary package enclosure blank 310 includes enclosure base 120 and enclosure door 130. Enclosure door 130 includes front panel 132, left and right side panels 136 and 134, and lower panel 138. In FIG. 4, top panel 335 is folded along fold 19 (FIG. 3), and top panel 335 is coupled to a portion of itself using adhesive strip 336 (FIG. 3). Elements similarly numbered and described in FIGS. 1-3 function in a substantially similar way. In FIG. 4, packaging system 400 may include other elements not relevant to the present discussion.

In FIG. 4, adhesive strip 434 is applied to a portion of panel 334 of left-side panel 136, and adhesive strip 432 is applied to a portion of panel 332 of right-side panel 134. In some embodiments, adhesive strip 434 is applied to a substantially rectangular portion of panel 334, and adhesive strip 432 is applied to a substantially rectangular portion of panel 332. Similarly, adhesive strip 433 is applied to a portion of panel 333, and adhesive strip 431 is applied to a portion of panel 331. Adhesive strip 454 is applied to a portion of panel 354, and adhesive strip 435 is applied to a portion of top panel 335. In some embodiments, adhesive is applied as a single strip to the portions depicted in FIG. 4 as adhesive strips 431, 433, 435, and 454.

Next, film 430 is laid over front panel 132 so as to contact adhesive strips 431, 433, 435 and 454. In some embodiments, film 430 is configured to fit within an area defined by folds 8, 11, and 12. Finally, panel 334 is further folded along fold 12 to mate with panel 333, and panel 332 is further folded along fold 11 to mate with panel 331. In some embodiments, fold 11 is a further extension of fold 6 (FIG. 3), and fold 12 is a further extension of fold 7 (FIG. 3). In other embodiments, fold 11 is not a further extension of fold 6 (FIG. 3), and fold 12 is not a further extension of fold 7 (FIG. 3).

Figure 5:
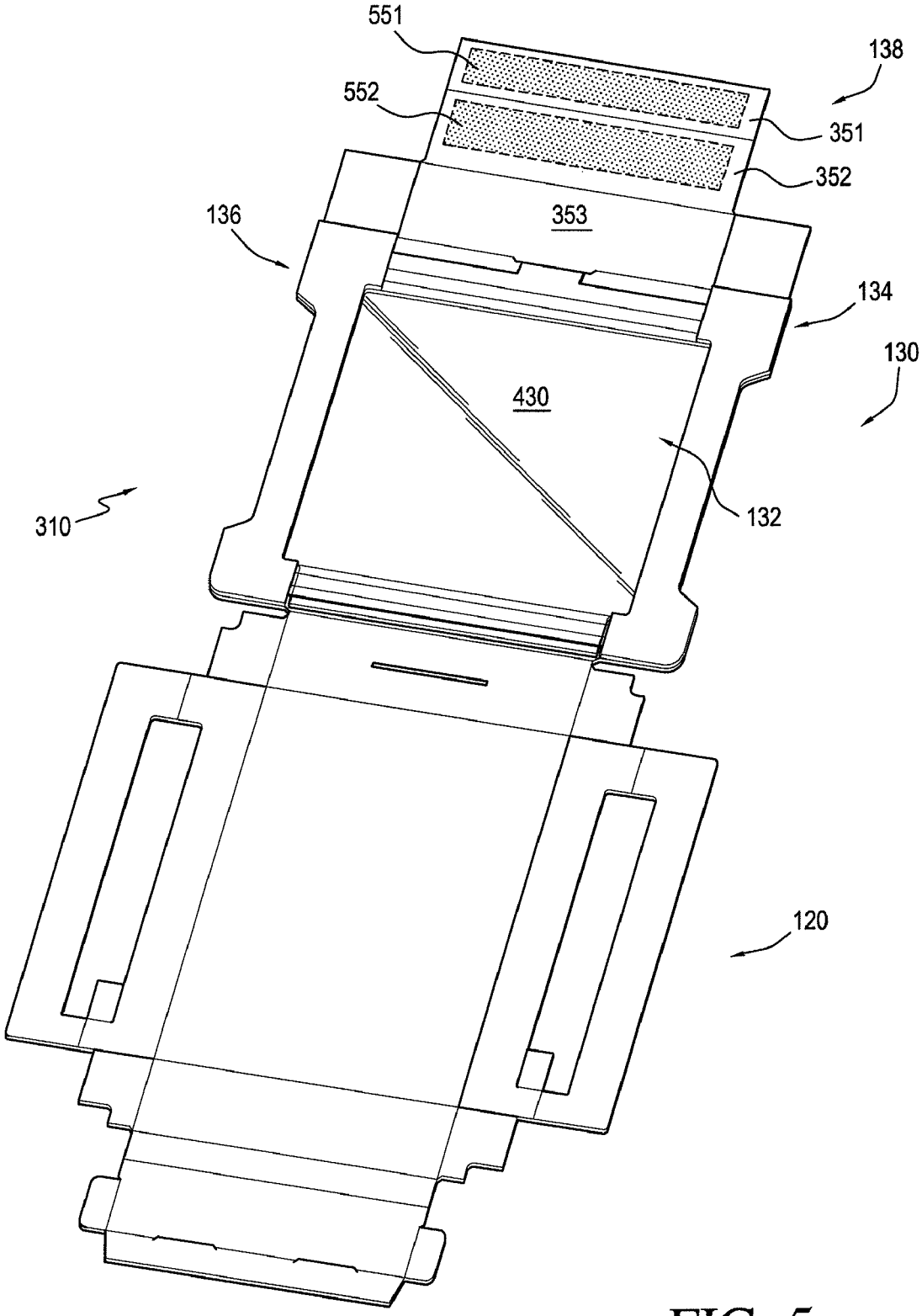
FIG. 5 is a perspective view that illustrates the exemplary package enclosure blank of FIG. 4 with additional adhesive strips, according to an embodiment of the subject matter described herein.

FIG. 5 is a perspective view that illustrates exemplary package enclosure blank 310 with additional adhesive strips. Exemplary package enclosure blank 310 includes enclosure base 120 and enclosure door 130. Enclosure door 130 includes front panel 132 including film 430, left side panel 136, right side panel 134 and lower panel 138. In FIG. 5, elements similarly numbered and described in FIGS. 1-4 function in a substantially similar way. Packaging system 500 may include other elements not relevant to the present discussion.

In FIG. 5, lower panel 138, adhesive strip 551 is applied to a portion of panel 351 of lower panel 138, and adhesive strip 552 is applied to a portion of panel 352 of lower panel 138. In some embodiments, adhesive strip 551 is applied to a substantially rectangular portion of panel 351, and adhesive strip 552 is applied to a substantially rectangular portion of panel 352.

Figure 6:
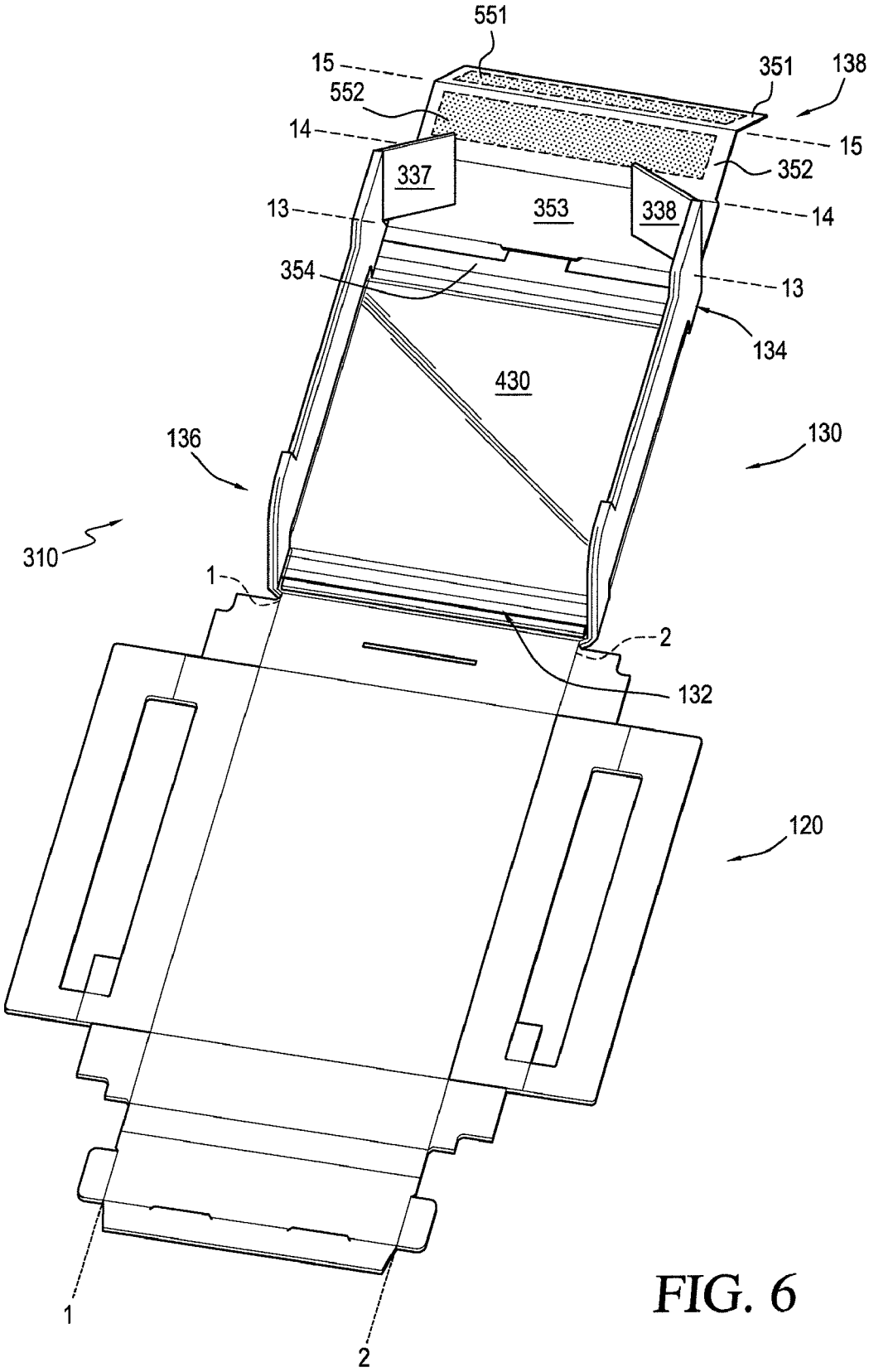
FIG. 6 illustrates the exemplary package enclosure blank of FIG. 5 partially folded into the exemplary package enclosure of FIG. 1, according to an embodiment of the subject matter described herein.

FIG. 6 illustrates exemplary package enclosure blank 310 partially folded into exemplary package enclosure 110. Exemplary package enclosure blank 310 includes enclosure base 120 and enclosure door 130. Enclosure door 130 includes front panel 132 including film 430, left side panel 136, right-side panel 134 and lower panel 138. In FIG. 6, elements similarly numbered and described in FIGS. 1-5 function in a substantially similar way. Packaging system 600 may include elements not relevant to the present discussion.

In FIG. 6, right-side panel 134 is folded along fold 2 (or fold 9 in FIG. 3) sloping in an upward manner. In some embodiments, right-side panel 134 is folded along fold 2 (or fold 9 in FIG. 3) sloping in an upward manner resulting in right-side panel 134 positioned to slope upward at about a 90° angle from the surface of front panel 132. Similarly, left-side panel 136 is folded along fold 1 (or fold 10 in FIG. 3) sloping in an upward manner. In some embodiments, left-side panel 136 is folded along fold 1 (or fold 10 in FIG. 3) sloping in an upward manner resulting in left-side panel 136 positioned to slope upward at about a 90° angle from the surface of front panel 132.

In FIG. 6, tab 337 has already been cut away from panel 353 by cutting along fold 1 (or fold 10 in FIG. 3) between fold 14 and fold 13. Tab 337 is then folded along fold 13 sloping in an inward manner. In some embodiments, tab 337 is folded along fold 13 sloping in an inward manner resulting in tab 337 positioned to slope inward at about a 45° angle from left-side panel 136. Tab 338 has been cut away from panel 353 by cutting along fold 2 (or fold 9 in FIG. 3) between fold 14 and fold 13. Tab 338 is then folded along fold 13 sloping in an inward manner. In some embodiments, tab 338 is folded along fold 13 sloping in an inward manner resulting in tab 338 positioned to slope inward at about a 45° angle from right-side panel 134. In some embodiments, tabs 337 and 338 are cut away from panel 353 before left-side panel 136 and right-side panel 134 are folded. In other embodiments, tabs 337 and 338 are cut away from panel 353 after left-side panel 136 and right-side panel 134 are folded.

Next, panel 352 is folded along fold 14 sloping in an inward manner. In some embodiments, panel 352 is folded along fold 14 sloping in an inward manner resulting in panel 352 positioned to slope inward at about a 45° angle from the blank and specifically panel 353 of lower panel 138. Finally, panel 351 is folded along fold 15 sloping in an outward manner. In some embodiments, panel 351 is folded along fold 14 sloping in an outward manner resulting in panel 351 positioned to slope outward at about a 45° angle from the end of panel 352 of lower panel 138 in physical communication with fold 15. In other embodiments, panels 351 and 352 can be folded in the opposite order. In yet other embodiments, panels 351 and 352 can be folded simultaneously.

Panel 353 of lower panel 138 is folded along fold 13 sloping in an upward manner. In some embodiments, panel 353 is folded along fold 13 sloping in an upward manner resulting in panel 353 positioned to slope upward at about a 90° angle from the surface of front panel 132. Tabs 337 and 338 are then further folded along fold 13 sloping in an inward manner so as to be mechanically coupled to panel 353. Next, panel 352 is further folded along fold 14 resulting in adhesive strip 552 and panel 352 to rotate and affixedly couple with the interior portions of tabs 337 and 338 (illustrated in FIG. 7, below). Finally, panel 351 including adhesive strip 551 of lower panel 138 is further folded along fold 15 to affixedly couple with the lower interior portions of film 430, panel 354, and front panel 132 (illustrated in FIG. 7).

Figure 7:
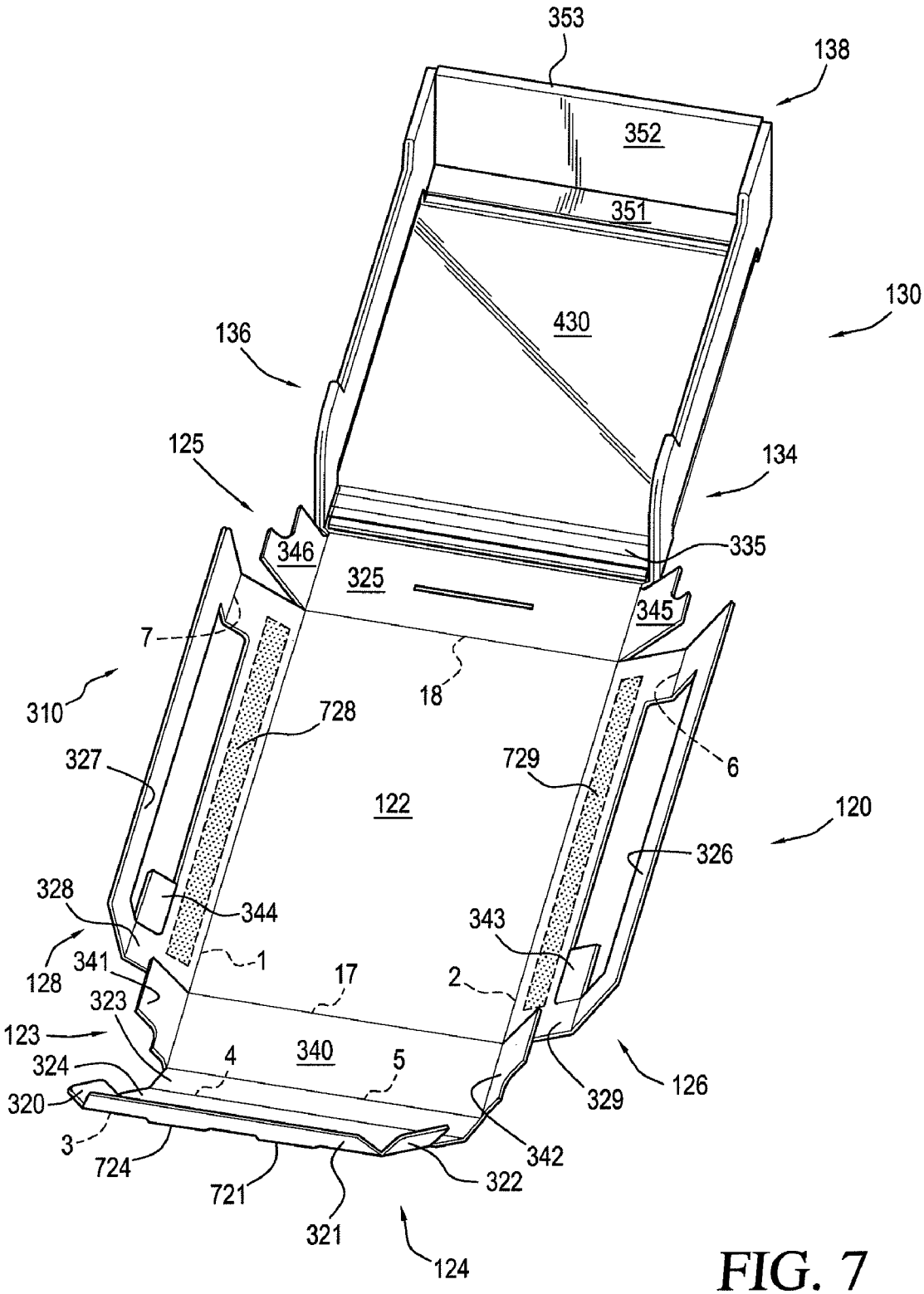
FIG. 7 illustrates exemplary package enclosure blank of FIG. 6 further partially folded into the exemplary package enclosure of FIG. 1, according to an embodiment of the subject matter described herein.

FIG. 7 illustrates exemplary package enclosure blank 310 of FIG. 6 further partially folded into exemplary package enclosure 110. Exemplary package enclosure blank 310 includes enclosure base 120 and enclosure door 130. Enclosure base 120 includes a back panel 122, left and right side panels 126 and 128, a top panel 125, a bottom interior panel 124 and a bottom exterior panel 123. Enclosure door 130 includes front panel 132 including film 430, left side panel 136, right-side panel 134 and lower panel 138. In FIG. 7, elements similarly numbered and described in FIGS. 1-6 function in a substantially similar way. Packaging system 700 may include other elements not relevant to the present discussion.

Figure 8:
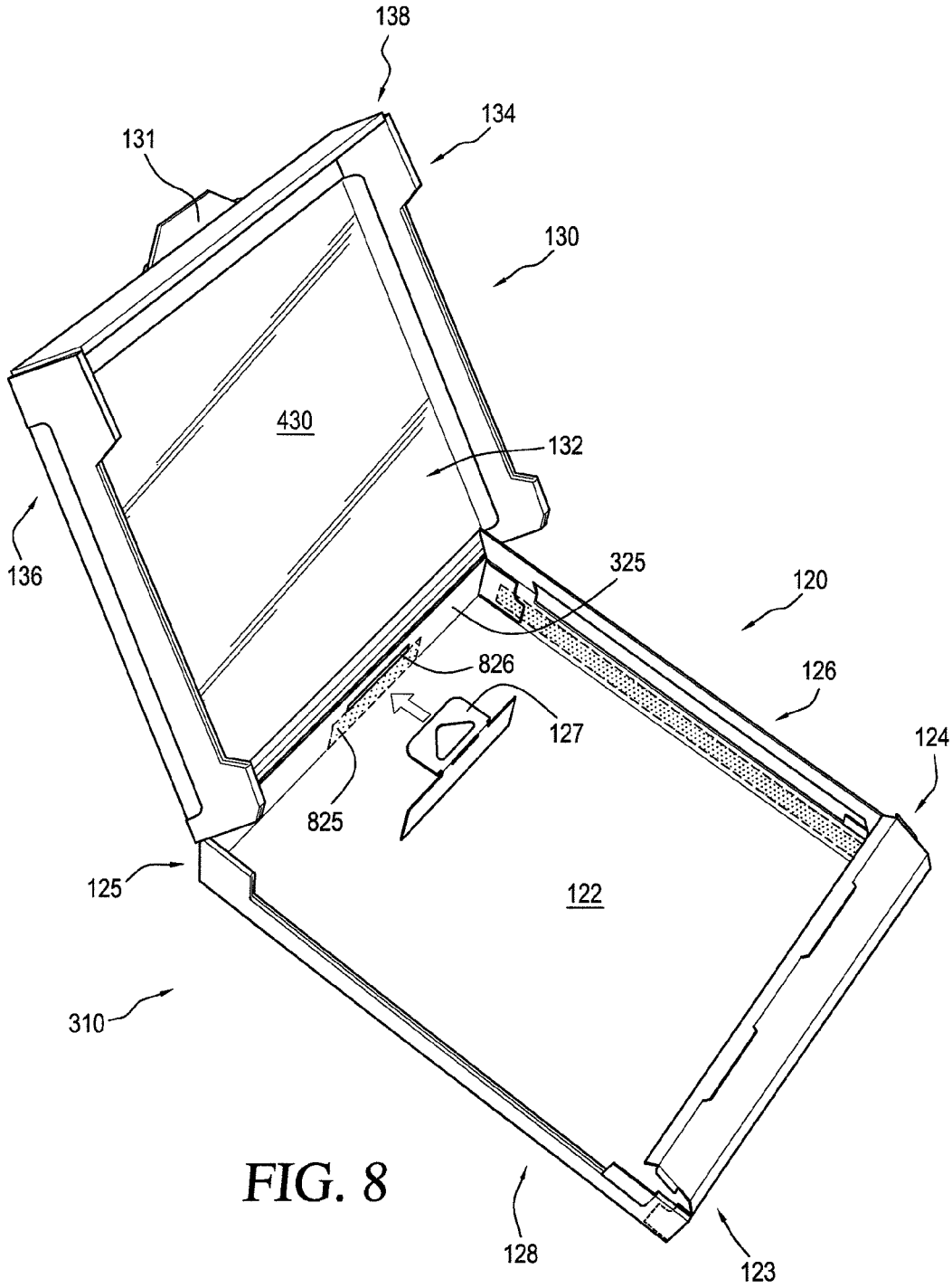
FIG. 8 illustrates the exemplary package enclosure blank of FIG. 7 with a hanger and further partially folded into the exemplary package enclosure of FIG. 1, according to an embodiment of the subject matter described herein.

In FIG. 7, adhesive strip 728 is applied to a portion of panel 328 of left-side panel 128, and adhesive strip 729 is applied to a portion of panel 329 of right-side panel 126. In some embodiments, adhesive strip 728 is applied to a substantially rectangular portion of panel 328, and adhesive strip 729 is applied to a substantially rectangular portion of panel 329. Finally, panel 327 is further folded along fold 7 to mate with panel 328, and panel 326 is further folded along fold 6 to mate with panel 329. FIG. 7 illustrates package enclosure blank 310 before the mating, and FIG. 8 illustrates package enclosure blank 310 after the mating.

In FIG. 7, tab 346 is cut away from panel 328 by cutting along fold 18 from the exterior of enclosure base 120 to fold 1. Tab 346 is then folded along fold 1 sloping in an inward manner. In some embodiments, tab 346 is folded along fold 1 sloping in an inward manner resulting in tab 346 positioned to slope inward at about a 45° angle from left-side panel 128 or panel 325. Tab 345 is cut away from panel 329 by cutting along fold 18 from the exterior of enclosure base 120 to fold 2. Tab 345 is then folded along fold 2 sloping in an inward manner. In some embodiments, tab 345 is folded along fold 2 sloping in an inward manner resulting in tab 345 positioned to slope inward at about a 45° angle from right-side panel 126 or panel 325. In some embodiments, tabs 345 and 346 are cut away from panels 329 and 328, respectively, before portions of left-side panel 128 and right-side panel 126 are folded. In other embodiments, tabs 345 and 346 are cut away from panels 329 and 328, respectively, after portions of left-side panel 128 and right-side panel 126 are folded.

Panel 323 is further folded along fold 5 sloping in an inward manner. In some embodiments, panel 323 is folded along fold 5 sloping in an inward manner resulting in panel 323 positioned to slope inward at about a 45° angle from front panel 132. Next, panel 324 is further folded along fold 4 sloping in an inward manner. In some embodiments, panel 324 is folded along fold 4 sloping in an inward manner resulting in panel 324 positioned to slope inward at about a 45° angle from the end of panel 323 in physical communication with fold 4. Next, panel 321 is further folded along fold 3 sloping in an inward manner. In some embodiments, panel 321 is folded along fold 3 sloping in an inward manner resulting in panel 321 positioned to slope inward at about a 45° angle from the end of panel 324 in physical communication with fold 3. In other embodiments, panels 321, 323 and 324 can be folded in the opposite order. In yet other embodiments, panels 321, 323 and 324 can be folded simultaneously.

In some embodiments, a bottom edge of panel 324 along fold 3 includes a plurality of slots configured to receive a plurality of small tabs. In some embodiments, a bottom edge of panel 324 includes a plurality of slots, for example enclosure base slots 721 and 724, configured to each receive an associated tab, for example, tabs 1026 of box insert blank 1020 of exemplary product display 1100 of FIG. 10.

In FIG. 7, tab 341 is cut away from panel 328 by cutting along fold 17 from the exterior of enclosure base 120 to fold 1. Tab 341 is then folded along fold 1 sloping in an inward manner. In some embodiments, tab 341 is folded along fold 1 sloping in an inward manner resulting in tab 341 positioned to slope inward at about a 45° angle from panel 340. Tab 342 is cut away from panel 329 by cutting along fold 17 from the exterior of enclosure base 120 to fold 2. Tab 342 is then folded along fold 2 sloping in an inward manner. In some embodiments, tab 342 is folded along fold 2 sloping in an inward manner resulting in tab 342 positioned to slope inward at about a 45° angle from panel 340. In some embodiments, tabs 341 and 342 are cut away from panels 328 and 329, respectively, before portions of panels 321, 323 and 324 are folded. In other embodiments, tabs 341 and 342 are cut away from panels 328 and 329, respectively, after panels 321, 323 and 324 are folded.

FIG. 8 illustrates exemplary package enclosure blank 310 of FIG. 7 with a hanger 127 and further partially folded into exemplary package enclosure 110 of FIG. 1. Exemplary package enclosure blank 310 includes enclosure base 120 and enclosure door 130. Enclosure base 120 includes a back panel 122, left and right side panels 126 and 128, a top panel 125, a bottom interior panel 124, and a bottom exterior panel 123. Enclosure door 130 includes front panel 132 including film 430, left side panel 136, right-side panel 134 and lower panel 138. In FIG. 8, elements similarly numbered and described in FIGS. 1-7 function in a substantially similar way. Packaging system 800 may include other elements not relevant to the present discussion.

In FIG. 8, panel 325 of top panel 125 includes a slot 826 configured to receive a portion of hanger 127. Hanger 127 is configured to include a base portion configured to attach to a portion of enclosure base 120 as well as a hanging portion configured to traverse slot 826 to allow package enclosure blank 310, when fully configured, to hang from a display hook. In FIG. 8, a hanger adhesive strip 825 is applied to a portion of panel 325 in a region where the base of hanger 127 will contact panel 325 when the hanging portion of hanger 127 is traversing slot 826.

Figure 9:
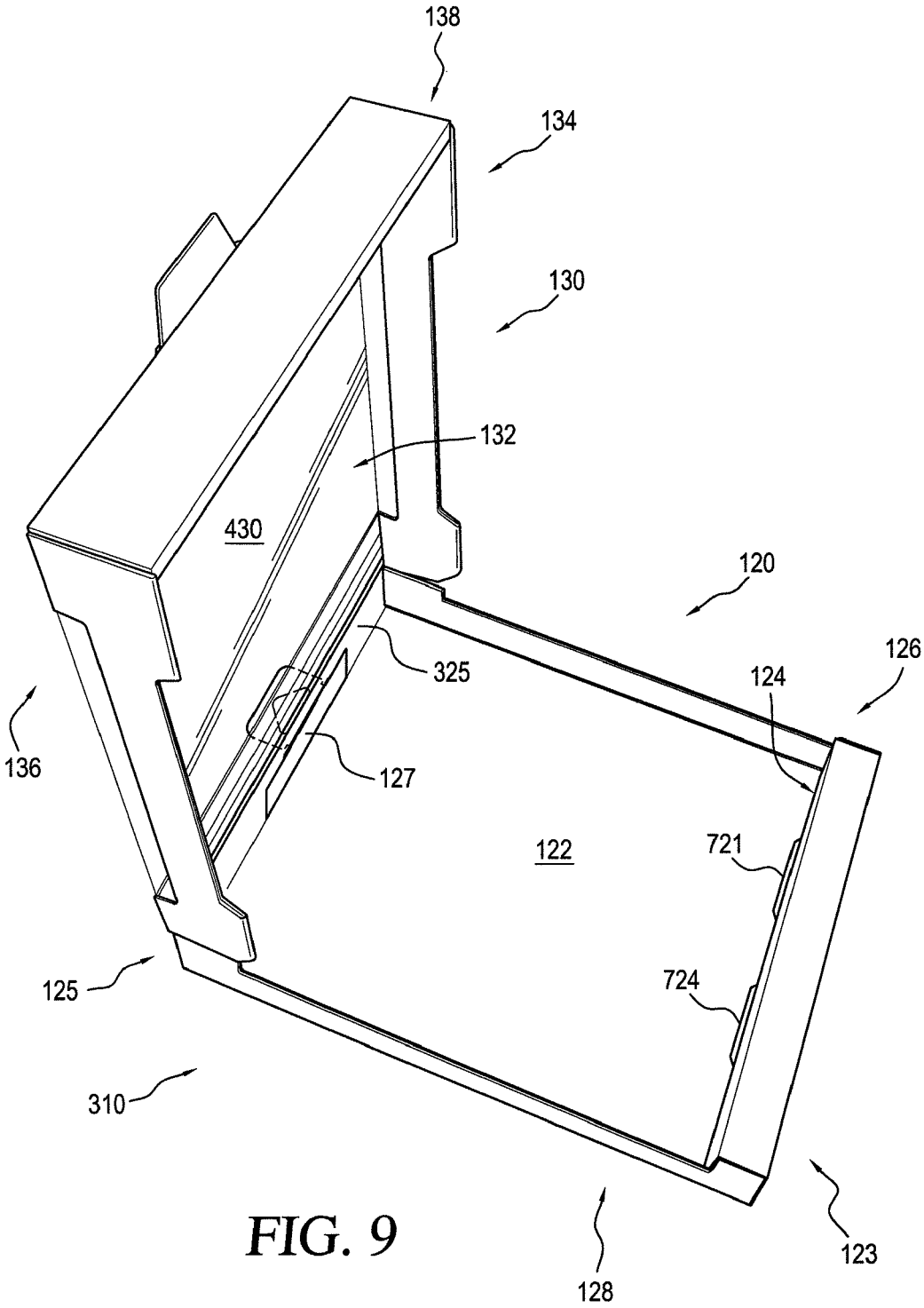
FIG. 9 illustrates the exemplary package enclosure blank of FIG. 8 coupled to the hanger of FIG. 8, according to an embodiment of the subject matter described herein.

FIG. 9 illustrates exemplary package enclosure blank 310 of FIG. 8 coupled to hanger 127. Exemplary package enclosure blank 310 includes enclosure base 120 and enclosure door 130. Enclosure base 120 includes a back panel 122, left and right side panels 126 and 128, a top panel 125, a bottom interior panel 124 and a bottom exterior panel 123. Enclosure door 130 includes front panel 132 including film 430, left side panel 136, right-side panel 134 and lower panel 138. In FIG. 9, elements similarly numbered and described in FIGS. 1-8 function in a substantially similar way. Packaging system 900 may include other elements not relevant to the present discussion. In FIG. 9, panel 325 of top panel 125 is depicted as having received hanger 127 through slot 826.

FIG. 10 illustrates a product mounting blank and a box insert blank for mounting within the blank of FIG. 9. FIG. 10 includes product display system 1000 including an exemplary product display 150. Exemplary product display 150 includes box insert blank 1020 and product mounting blank 1030. Box insert blank 1020 can include: (a) back panel 1021; (b) top panel 1022; (c) left-side panel 1023; (d) right-side panel 1024; (e) product mounting slots 1025; (f) box insert tabs 1026; and (g) adhesive strips 1036, 1027 and 1028.

Product mounting blank 1030 can include: (a) back panel 1031; (b) blank mounting tabs 1033; (c) right-side panel 1034; and (d) left-side panel 1035. Product display system 1000 may include other elements not relevant to the present discussion.

In FIG. 10, back panel 1021 of box insert blank 1020 is formed folding a top edge, a left-side edge and a right-side edge along folds 30, 31, and 32, respectively. Panel 1022 is formed folding the top edge of back panel 1021 along folds 30. Panel 1023 is formed by folding the left edge of back panel 1021 along fold 31. Panel 1024 is formed by folding the right edge of back panel 1021 along fold 32.

Tabs 1026 are formed along the bottom edge of back panel 1021, and slots 1025 are formed within the area not associated with the aforementioned panels and are configured to receive associated tabs 1033 from product mounting blank 1030. In one embodiment, slots 1025 are formed in a row and column substantially square pattern with each column of the substantially square pattern arranged to align with tabs 1026. Adhesive strip 1027 is applied to a portion of left-side panel 1023, and adhesive strip 1028 is applied to a portion of right-side panel 1024. In some embodiments, adhesive strip 1027 is applied to a substantially rectangular portion of left-side panel 1023, and adhesive strip 1028 is applied to a substantially rectangular portion of right-side panel 1024. Next, left-side panel 1023 is further folded along fold 31 and adhesively coupled to a portion of back panel 1021. Right-side panel 1024 is further folded along fold 32 and adhesively coupled to another portion of back panel 1021. Tabs 1026 are configured to partially secure box insert blank 1020 within an assembled package enclosure blank 310, such as, for example the package enclosure blank 310 of FIG. 9, above.

As illustrated in the embodiment of FIG. 10, back panel 1031 of product mounting blank 1030 is formed by folding left-side edge and a right-side edge of back panel 1031 along folds 33 and 34, respectively. Left-side panel 1035 is formed by folding the left edge of back panel 1031 along fold 33.

Right-side panel 1034 is formed by folding the right edge of back panel 1031 along fold 34.

Tabs 1033 are configured to mate with slots 1025 of box insert blank 1020. Although FIG. 10 shows two tabs 1033 and slots 1025, other embodiments can use a different number of tabs 1033 and slots 1025. Finally, after product mounting blank 1030 is mated to box insert blank 1020, adhesive strips 1036 are configured to secure tabs 1033 of product mounting blank 1030 within slots 1025 of box insert blank 1020.

Back panel 1031, right-side panel 1034, and left-side panel 1035 of product mounting blank 1030 are configured to afford a product a structure upon which to be mounted. In some embodiments, the product may require additional preparation so that the product can be mounted to the panel portion of product mounting blank 1030 while tabs 1033 remain available to interact with the associated slots of 1025 of box insert blank 1020.

FIG. 11 illustrates box insert blank 1020 after folding a portion of box insert blank 1020 and inserting and securing product mounting blank 1030. FIG. 11 includes product display system 1100 including an exemplary product display 1010. Exemplary product display 1010 includes box insert blank 1020 and product mounting blank 1030 (not shown) that is located behind box insert blank 1020. Box insert blank 1020 includes back panel 1021 top panel 1022, left-side panel 1023, right-side panel 1024, product mounting slots 1025 and box insert tabs 1026. Product mounting blank 1030 includes blank mounting tabs 1033 and mounting adhesive strips 1036. In FIG. 11, elements similarly numbered and described in FIG. 10 function in a substantially similar way. Product display system 1100 may include other elements not relevant to the present discussion.

In FIG. 11, box insert blank 1020 of exemplary product display 1010 is depicted as having received mounting blank 1030 via blank mounting tabs 1033 of mounting blank 1030 mating with associated product mounting slots 1025 of box insert blank 1020. Adhesive 1036 is used to hold tabs 1033 to box insert blank 1020.

Figure 12:
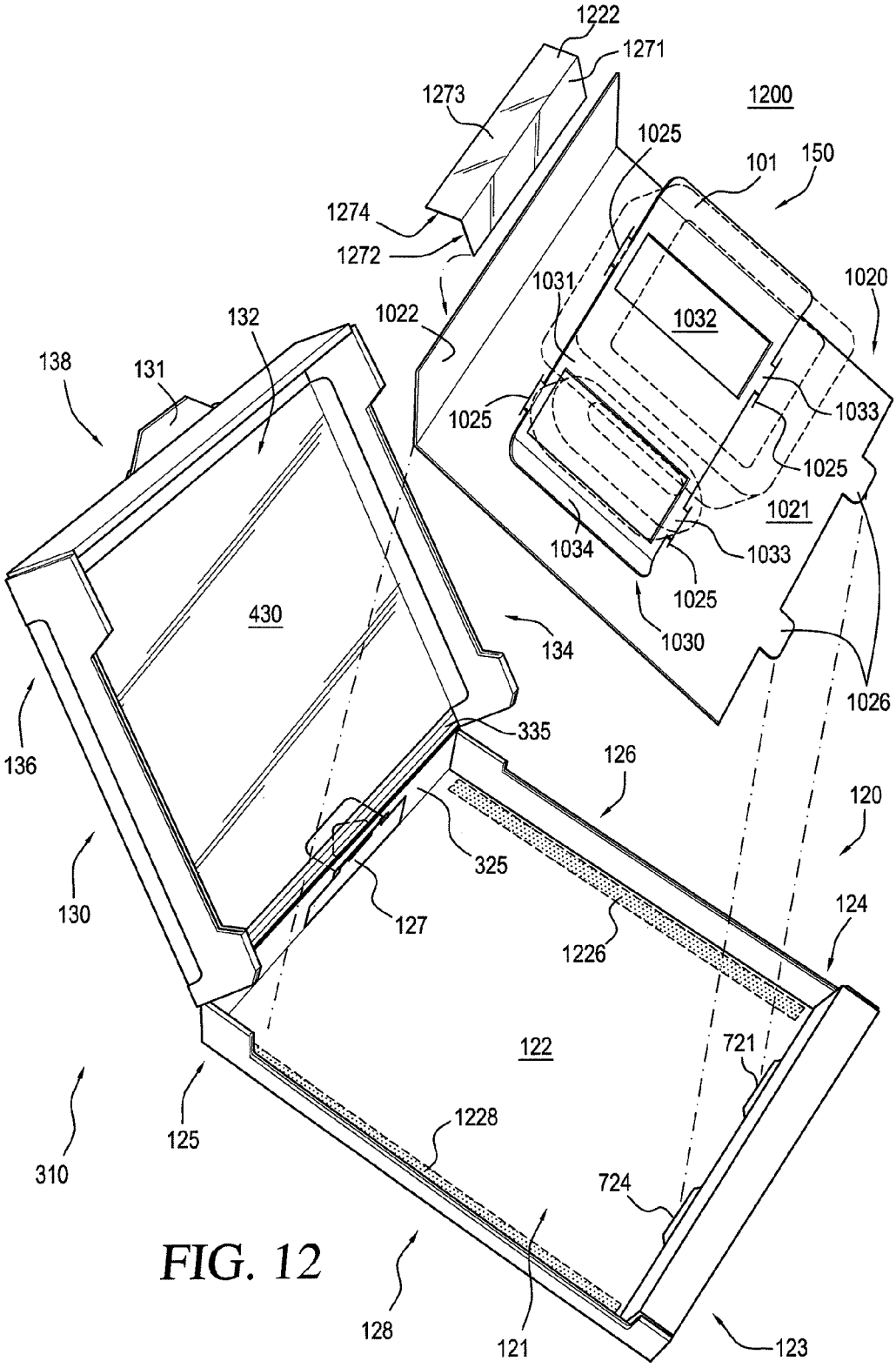
FIG. 12 illustrates the exemplary package enclosure blank of FIG. 9 and the product display system of FIG. 11, according to an embodiment of the subject matter described herein.

FIG. 12 illustrates the exemplary package enclosure blank 310 and product display 150. FIG. 12 includes packaging system 1200 including exemplary package enclosure 110. Packaging system 1200 is merely exemplary and is not limited to the embodiments presented herein. Packaging system 1200 can be employed in many different embodiments or examples not specifically depicted or described herein.

Exemplary package enclosure 110 includes enclosure base 120, enclosure door 130 and exemplary product display 150 that includes box insert blank 1020, mounting blank 1030 and product 101. Enclosure base 120 includes cavity 121, back panel 122, left-side panel 128, right-side panel 126, top panel 125, bottom interior panel 124, bottom exterior panel 123 and adhesive strips 1226 and 1228. Enclosure door 130 includes front panel 132 including film 430, enclosure door tab 131, left side panel 136, right-side panel 134, lower panel 138 and adhesive strip 1222. Box insert blank 1020 includes back panel 1021 top panel 1022, product mounting slots 1025 and box insert tabs 1026. Product mounting blank 1030 includes back panel 1031, blank mounting tabs 1033, right-side panel 1034 and left-side panel 1035 (not shown). In FIG. 12, elements similarly numbered and described in FIGS. 1-11 function in a substantially similar way. Packaging system 1200 may include other elements not relevant to the present discussion.

In FIG. 12, adhesive strip 1226 is applied to a portion of back panel 122 of enclosure base 120, and adhesive strip 1228 is applied to another portion of back panel 122 of enclosure base 120. In some embodiments, adhesive strip 1226 is applied to a substantially rectangular portion of back panel 122 running along the right edge of back panel 122 near fold 2 (FIG. 3), and adhesive strip 1228 is applied to a substantially rectangular portion of back panel 122 running along the right edge of back panel 122 near fold 1 (FIG. 3). In the same or different embodiments, adhesive strips 1226 and 1228 are applied to adhesively couple left-side panel 1023 (FIG. 10) and right-side panel 1024 (FIG. 10), respectively, to portions of back panel 122.

Adhesive strip 1222 includes a first portion having a first side 1272 and a second side 1271. Sides 1271 and 1272 are configured to each have an adhesive surface (e.g., two-sided tape). Adhesive strip 1222 additionally includes a second portion having a first side 1274 configured to have an adhesive surface and a second side 1273 configured to not have an adhesive surface (e.g., single-sided tape). In FIG. 12, the second side 1271 of the first portion of adhesive strip 1222 is adhesively attached to a backside portion of panel 1022 of box insert blank 1020. In some embodiments, the second side 1271 of the first portion of adhesive strip 1222 is applied to a substantially rectangular portion of the backside of panel 1022.

As previously discussed, exemplary product display 150 is configured to be contained within cavity 121 of enclosure base 120. In FIG. 12, cavity 121 of enclosure base 120 is depicted as receiving box insert blank 1020 via box insert tabs 1026 of box insert blank 1020 mating with associated enclosure base slots 721 and 724 of enclosure base 120.

Adhesive strips 1226 and 1228 of back panel 122 adhesively couple left-side panel 1023 (FIG. 10) and right-side panel 1024 (FIG. 10) of box insert blank 1020 to associated portions of back panel 122. First side 1272 of the first portion of adhesive strip 1222 of box insert blank 1020 adhesively couples portions of the backside of panel 1022 of box insert blank 1020 to panel 325. In some embodiments, the first side 1274 of the second portion of adhesive strip 1222 is adhesively coupled to a portion of film 430 overlying top panel 335.

In other embodiments, the above description details a more secure adhesive binding between the backside of panel 1022 to panel 325 and further details a less secure adhesive binding between the first side 1274 of the second portion of adhesive strip 1222 and the portion of film 430. Because of this configuration, product display 150 remains secure within cavity 121 allowing a customer to access the product contained therein by opening the lid while not allowing the product to be removed from cavity 121 without fatally damaging enclosure base 120. Similarly, when a customer purchases the product included within package enclosure 110, the product can be removed by grasping second portion of adhesive strip 1222, removing the first side of the second portion of adhesive strip 1222 from film 430 and using the second portion of adhesive strip 1222 to tear panel 1022 from panel 325, thereby fatally damaging enclosure base 120.

To protect product 101 in one embodiment, product 101 is coupled to product mounting blank 1030 at region 1032 such that product 101 cannot be removed from product mounting blank 1030 until after product mounting blank 1030 is removed from box insert blank 1020. Box insert blank 1020 is coupled to enclosure base 110 such that box insert blank 1020 can only be removed from enclosure base 110 by ripping or tearing adhesive 1222. Tear or ripping adhesive 1222 substantially damages enclosure base 110. Therefore, product 101 cannot be removed from product mounting blank 1030 until enclosure base 110 is substantially damaged.

In some examples, product 101 can be coupled to product mounting blank 1030 using twist ties that pass through holes in regions 1032 that only can be only removed after removing product mounting blank 1030 from box insert blank 1020. In other embodiments, other secure attachment methods can be used.

The product mounting blank can be configured to pass through a portion of a product configured to receive the product mounting blank in some examples.

Figure 13:
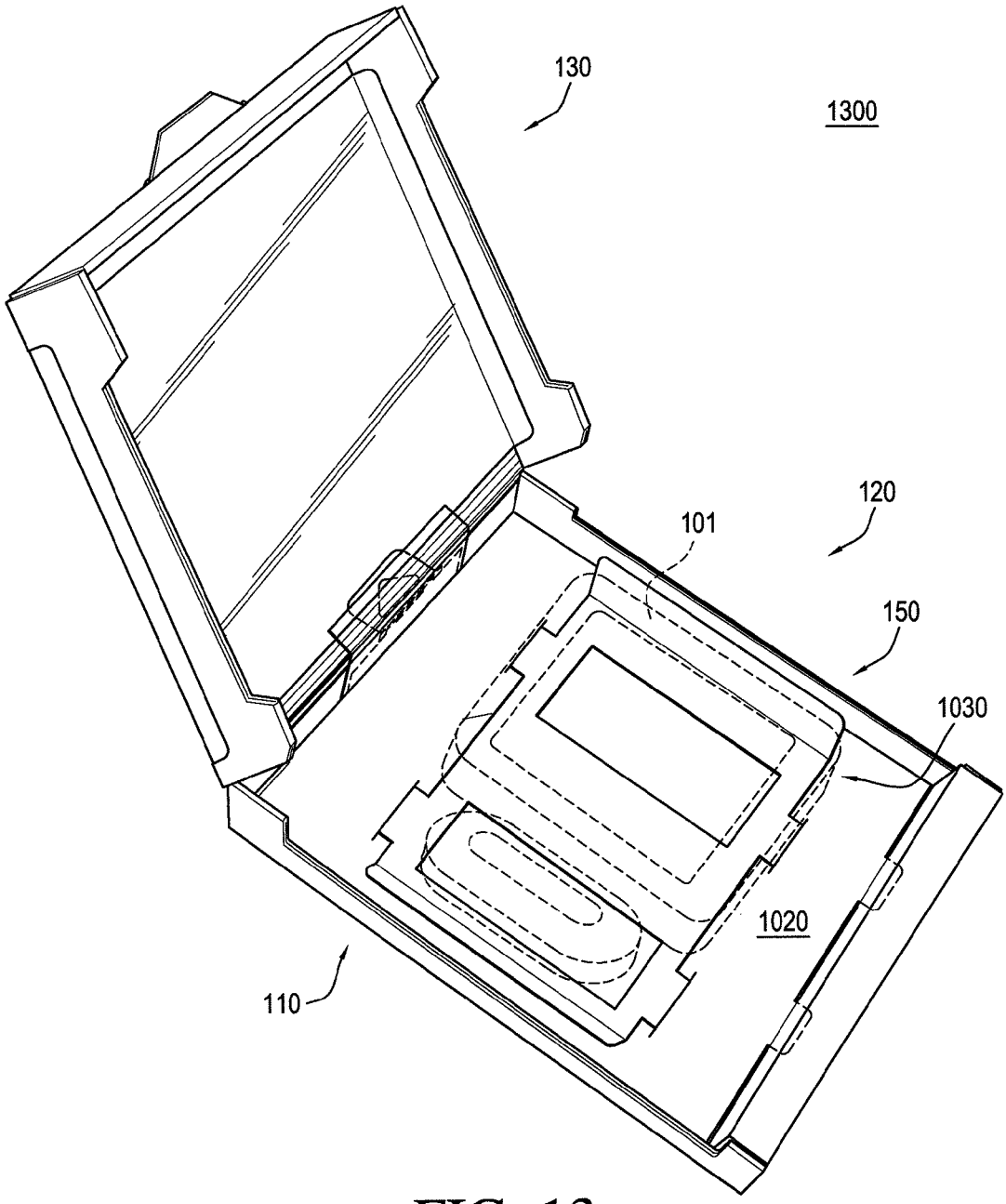
FIG. 13 is a perspective view of the open exemplary package enclosure of FIG. 2 that illustrates a fully formed box including the product mounting blank of FIG. 11 and further illustrating one or more products in dashed lines, according to an embodiment of the subject matter described herein.

FIG. 13 is a perspective view that illustrates a fully formed box including a box insert having a product mounting blank and further illustrating a product in dashed lines. FIG. 13 includes packaging system 1300 including an exemplary package enclosure 110. Packaging system 1300 is merely exemplary and is not limited to the embodiments presented herein. Packaging system 1300 can be employed in many different embodiments or examples not specifically depicted or described herein.

Exemplary package enclosure 110 includes enclosure base 120, enclosure door 130 and exemplary product display 150 that includes box insert blank 1020, mounting blank 1030 and product 101. In FIG. 13, elements similarly numbered and described in FIGS. 1-12 function in a substantially similar way. Packaging system 1300 may include other elements not relevant to the present discussion. FIG. 13 depicts exemplary product display 150 including product 101 secured within enclosure base 120. FIG. 13 additionally depicts how a user may interact both visually and tactilely with product 101 of packaging system 1300.

Figure 14:
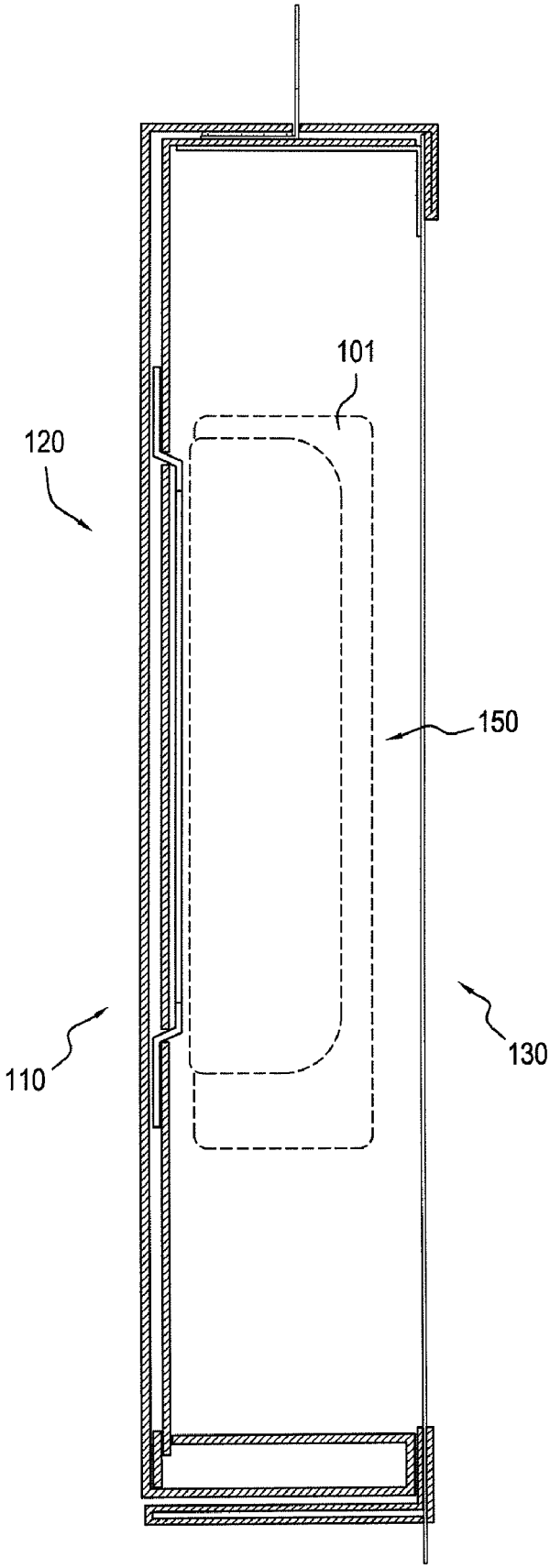
FIG. 14 is a sectional view along line 14-14 of FIG. 1 that illustrates a side view of the fully formed box of FIG. 1 and further illustrating one or more products in dashed lines and including improved customer interaction characteristics, according to an embodiment of the subject matter described herein.

FIG. 14 is a sectional view along line 14-14 of FIG. 1 that illustrates a side view of a fully formed box and further illustrating a product in dashed lines according to one embodiment of an exemplary package enclosure including improved customer interaction characteristics. FIG. 14 includes packaging system 1400 including an exemplary package enclosure 110. Packaging system 1400 is merely exemplary and is not limited to the embodiments presented herein. Packaging system 1400 can be employed in many different embodiments or examples not specifically depicted or described herein.

Exemplary package enclosure 110 includes enclosure base 120, enclosure door 130 and exemplary product display 150 that includes product 101 (not detailed). In FIG. 14, elements similarly numbered and described in FIGS. 1-13 function in a substantially similar way. Packaging system 1400 may include other elements not relevant to the present discussion.

Figure 15:
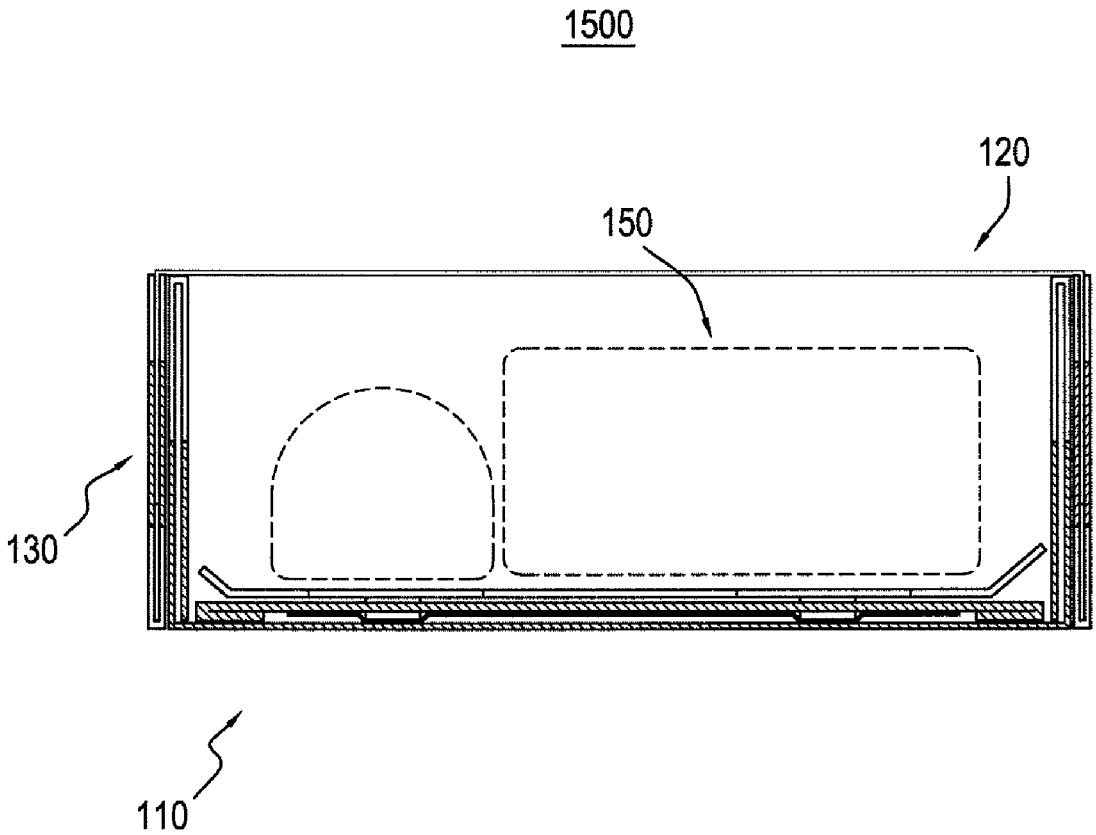
FIG. 15 is a sectional view along line 15-15 of FIG. 1 that illustrates a bottom-up view of the fully formed box of FIG. 1 and further illustrating one or more products in dashed lines and including improved customer interaction characteristics, according to an embodiment of the subject matter described herein.

FIG. 15 is a sectional view along line 15-15 of FIG. 1 that illustrates a bottom-up view of a fully formed box and further illustrating a product in dashed lines according to one embodiment of an exemplary package enclosure including improved customer interaction characteristics. FIG. 15 includes packaging system 1500 including an exemplary package enclosure 110. Packaging system 1500 is merely exemplary and is not limited to the embodiments presented herein. Packaging system 1500 can be employed in many different embodiments or examples not specifically depicted or described herein.

Exemplary package enclosure 110 includes enclosure base 120, enclosure door 130, and exemplary product display 150 that includes product 101 (not detailed). In FIG. 15, elements similarly numbered and described in FIGS. 1-14 function in a substantially similar way. Packaging system 1500 may include other elements not relevant to the present discussion.

In some embodiments, portions of package enclosure 110 (e.g., enclosure base 120 and enclosure door 130) and portions of exemplary product display 150 (e.g., box insert blank 1020) can each be manufactured from paperboard, chipboard, or another type of paper, cardboard or the like. Paperboard can be a high-performance unbleached, coated paperboard with acceptable printing characteristics and sufficient strength characteristics for general folding carton applications. An example of paperboard is Coated Natural Kraft (CNK®) board available from MeadWestvaco Coated Board of Phenix City, Ala. Chipboard can be pasteboard made from discarded paper and can be manufactured with or with out a coating, such as, for example a polyethylene coating. Examples of chipboard include Solid Bleached Sulfate (SBS) chipboard and Clay Coated News Back (CCNB) chipboard available from Techni-Pak of Irvine, Calif. In other embodiments, film 430 for viewing a product enclosed with a fully formed package enclosure 110, hanger 127 of the package enclosure blank 310 and product mounting blank 1030 can each be manufactured utilizing a plastic, such as, for example polyethylene terephthalate (PET), polyvinyl chloride (PVC), amorphous polyethylene terephthalate (APET) and/or ridged polyethylene terephthalate (RPET) available from Hop Industries Corporation of Lyndhurst, N.J.

Figure 16:
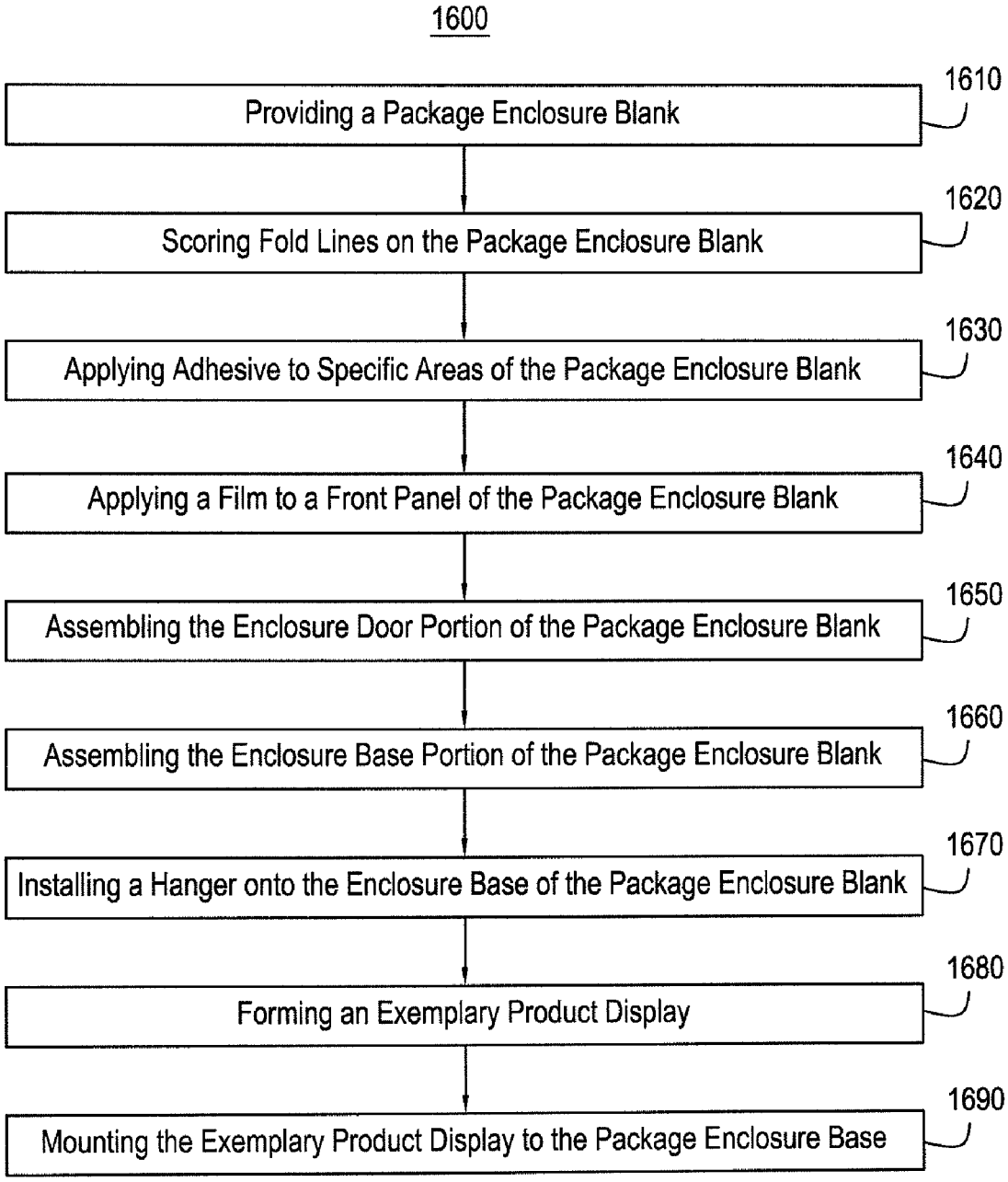
FIG. 16 illustrates a flow chart for a method of manufacturing a packaging enclosure, according to an embodiment.

FIG. 16 illustrates a flow chart 1600 for a method of manufacturing a packaging enclosure, according to an embodiment. Flow chart 1600 is merely exemplary and is not limited to the embodiments presented herein. Flow chart 1600 can be employed in many different embodiments or examples not specifically depicted or described herein. In some embodiments, the steps of the method described in flow chart 1600 can be performed in the order presented. In other embodiments, the steps of the method described in flow chart 1600 can be performed in any other suitable order. In still other embodiments, one or more of the steps described in flow chart 1600 can be combined.

Flow chart 1600 includes a step 1610 of providing a package enclosure blank. As an example, a package enclosure blank can be similar to package enclosure blank 310 of FIGS. 3-7, above.

Flow chart 1600 in FIG. 16 continues with a step 1620 of scoring fold lines on specific locations on the package enclosure blank. As an example, package enclosure blank 310 is scored along folds 1-18, as shown in FIGS. 3-7.

Flow chart 1600 in FIG. 16 continues with a step 1630 of applying adhesive to specific areas of the package enclosure blank. As an example, adhesive is applied to panels 332, 334, 335, 351 and 352 as well as portions of front panel 132 of package enclosure door 130 of package enclosure blank 310, as shown in FIGS. 3-7.

Flow chart 1600 in FIG. 16 continues with a step 1640 of applying a film to a front panel of the package enclosure door of the package enclosure blank. As an example, film 430 is applied to front panel 132 of package enclosure door 130 of package enclosure blank 310, as shown in FIG. 4.

Flow chart 1600 in FIG. 16 continues with a step 1650 of assembling the enclosure door portion of the package enclosure blank. In some embodiments, assembling the enclosure door portion of the package enclosure blank includes folding panels and tabs of the enclosure door of the package enclosure blank. As an example, panels 332 and 334 of package enclosure door 130 are folded, and then panels 134, 136, 351-353 of package enclosure door 130 as well as tabs 337 and 338 of enclosure door 130 are folded, as shown in FIGS. 3-6.

Flow chart 1600 in FIG. 16 continues with a step 1660 of assembling the enclosure base portion of the package enclosure blank. In some embodiments, assembling the enclosure base portion of the package enclosure blank includes folding panels and tabs of the enclosure base of the package enclosure blank. As an example, panels 326 and 327 of package enclosure base 120 are folded, and then panels 126, 128, 321, 323-325 and 340 of package enclosure base 120 as well as tabs 320, 322, 341, 342, 345 and 346 of enclosure base 120 are folded, as shown in FIGS. 7-9.

Flow chart 1600 in FIG. 16 continues with a step 1670 of installing a hanger onto the enclosure base of the package enclosure blank. In some embodiments, installing a hanger onto the enclosure base of the package enclosure blank includes installing a hanger onto the top panel of the enclosure base of the package enclosure blank. As an example, a hanger portion of hanger 127 traverses slot 826 of panel 325 of top panel 125 of enclosure base 120, and a base portion of hanger 127 is adhesively attached to a portion of panel 325, as shown in FIGS. 8 and 9.

Flow chart 1600 in FIG. 16 continues with a step 1680 of forming an exemplary product display for deployment into the enclosure base. In some embodiments, forming an exemplary product display includes affixing a product to a product mounting blank and then mounting the product mounting blank to a box insert blank. In some embodiments, the product mounting blank is slid through an opening in the product thereby securing the product to the product mounting blank. As an example, product 101 is affixed to product mounting blank 1030, and product mounting blank 1030 is mounted to box insert blank 1020 forming exemplary product display 150, as shown in FIGS. 10-11.

Finally, flow chart 1600 in FIG. 16 continues with a step 1690 of mounting the exemplary product display to the package enclosure base of the package enclosure blank. As an example, exemplary product display 150 is mounted to package enclosure base 120 of package enclosure 110, as shown in FIGS. 12-13.

Although the invention has been described with reference to specific embodiments, it will be understood by those skilled in the art that various changes may be made without departing from the spirit or scope of the invention. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that enclosure base does not have to be hingedly coupled to the enclosure door and that the foregoing discussion of certain of these embodiments does not necessarily represent a complete description of all possible embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A folding box configured to hold a product, the folding box comprising:

an enclosure base configured to form a cavity and comprising:

a first back panel;

a first left-side panel;

a first right-side panel;

a first bottom panel; and a first top panel;

an enclosure door coupled to the enclosure base, the enclosure door comprising:

a front panel having a second top panel;

a second left-side panel;

a second right-side panel; and a second bottom panel;

a box insert blank configured to be received within and fixedly attached within the cavity of the enclosure base and comprising a second back panel; and a product mounting blank configured to receive the product and configured to be fixedly attached to the box insert blank, wherein:

a portion of the second top panel of the enclosure door is hingedly coupled to a portion of the first top panel of the enclosure base such that the enclosure door can be moved between a first position, in which the enclosure base and the enclosure door substantially enclose the cavity, and a second position, in which the cavity is exposed;

the enclosure base and product mounting blank are further configured to securely hold the product such that a user of the folding box can place the enclosure door in the second position and touch the product without damaging the folding box;

the product mounting blank is further configured to securely hold the product such that the product cannot be removed from the product mounting blank without substantially damaging the folding box; and the front panel, the second left-side panel, the second right-side panel, and the second bottom panel are configured to at least partially enclose the enclosure base when the enclosure door is in the first position.

2. The folding box of claim 1, wherein the product mounting blank further comprises a least one blank mounting tab; and the box insert blank further comprises at least one associated product mounting slot configured to receive the at least one blank mounting tab.

3. The folding box of claim 2, wherein the box insert blank additionally includes two or more mounting adhesive strips configured to adhesively secure the at least one blank mounting tab within the at least one associated product mounting slot.

4. The folding box of claim 1, wherein the first bottom panel of the enclosure base comprises at least one enclosure base slot;

the box insert blank is sized to be substantially similar in size to the first back panel of the enclosure base;

the box insert blank further comprising at least one box insert tab;

each of the at least one enclosure base slot is associated with a different one of the at least one box insert tab; and each of the at least one box insert tab is configured to be received within an associated at least one enclosure base slot.

5. A folding box configured to hold a product, the folding box comprising:

an enclosure base configured to form a cavity and comprising:

a first back panel;

a first left-side panel;

a first right-side panel;

a first bottom panel; and a first top panel;

an enclosure door coupled to the enclosure base, the enclosure door comprising:

a front panel having a second top panel;

a second left-side panel;

a second right-side panel; and a second bottom panel;

a box insert blank configured to be received within and fixedly attached within the cavity of the enclosure base and comprising a second back panel; and a product mounting blank configured to receive the product and configured to be fixedly attached to the box insert blank, wherein:

a portion of the second top panel of the enclosure door is hingedly coupled to a portion of the first top panel of the enclosure base such that the enclosure door can be moved between a first position, in which the enclosure base and the enclosure door substantially enclose the cavity, and a second position, in which the cavity is exposed;

the front panel, the second left-side panel, the second right-side panel, and the second bottom panel are configured to at least partially enclose the enclosure base when the enclosure door is in the first position;

the first bottom panel of the enclosure base comprises at least one enclosure base slot;

the box insert blank is sized to be substantially similar in size to the first back panel of the enclosure base;

the box insert blank further comprising at least one box insert tab;

each of the at least one enclosure base slot is associated with a different one of the at least one box insert tab;

each of the at least one box insert tab is configured to be received within an associated at least one enclosure base slot;

the box insert blank additionally comprises a third top panel coupled to a top portion of the second back panel of the box insert blank;

the third top panel having a first surface and a second surface opposite the first surface, the third top panel is coupled to the second back panel, the second surface of the third top panel abutting the first top panel of the enclosure base; and the enclosure base additionally includes adhesive tape, the adhesive tape having:

a first portion having a first side and a second side, each of the first side and the second side of the first portion of the adhesive tape configured to have an adhesive surface, the first side of the first portion of the adhesive tape is configured to adhesively attach to the first top panel of the enclosure base and the second side of the first portion of the adhesive tape is configured to adhesively attach to the second surface of the third top panel of the box insert blank; and a second portion having a third side and a fourth side, the third side having an adhesive surface, the fourth side configured to not have an adhesive surface, the third side of the second portion of the adhesive tape is configured to adhesively attach to the second top panel of the front panel.

6. The folding box of claim 1, wherein the front panel of the enclosure door includes an opening, and wherein the front panel additionally includes a film covering the opening of the front panel.

7. The folding box of claim 1, wherein the second bottom panel or the front panel of the enclosure door includes an enclosure door tab protruding therefrom.

8. The folding box of claim 1, wherein the second left-side panel, the second right-side panel, and the second bottom panel abut the front panel at a substantially perpendicular orientation to the front panel.

9. The folding box of claim 1, the product mounting blank is configured to couple to the product using twist ties.

10. A package system configured to hold a product, the package system comprising:

a two-piece product display, the two-piece product display configured to receive the product; and a package enclosure, the package enclosure including an enclosure base configured to receive the two-piece product display, the package enclosure additionally including an enclosure door hingedly coupled to the enclosure base, the enclosure door when in a closed position is configured to mate with the enclosure base to enclose the product, wherein:

the two-piece product display comprises:

a box insert blank, the box insert blank configured to be received within and fixedly attached within the enclosure base; and a product mounting blank, the product mounting blank configured to receive the product such that a user can view and touch the product but the product cannot be removed from the product mounting blank without substantially damaging the package system, the product mounting blank further configured to fixedly attach to the box insert blank.

11. The package system of claim 10, wherein the product mounting blank is configured to pass through a portion of the product, the portion of the product configured to receive the product mounting blank.

12. The package system of claim 10, wherein the product mounting blank further comprises at least one blank mounting tab; and the box insert blank further comprises at least one associated product mounting slot configured to receive the at least one blank mounting tab.

13. The package system of claim 12, wherein the box insert blank additionally includes two or more mounting adhesive strips configured to adhesively secure the at least one blank mounting tab within the at least one associated product mounting slot.

14. The package system of claim 10, wherein the enclosure base comprises a first back panel, a first left-side panel, a first right-side panel, a first bottom panel, and a first top panel; and the first back panel, the first left-side panel, the first right-side panel, the first bottom panel, and the first top panel is are configured to form a cavity to receive the two-piece product display.

15. The package system of claim 14, wherein:

the enclosure door includes a front panel having a second top panel, a second left-side panel, a second right-side panel, and a second bottom panel;

a portion of the second top panel of the enclosure door is hingedly coupled to a portion of the first top panel of the enclosure base and is configured to allow the enclosure door to be moved between an open position and the closed position, the second left-side panel, the second right-side panel, and the second bottom panel abut the front panel at a substantially perpendicular orientation to the front panel; and the front panel, the second left-side panel, the second right-side panel, and the second bottom panel are configured to at least partially enclose the enclosure base when the enclosure door is in the closed position.

16. The package system of claim 15, wherein the front panel of the enclosure door includes an opening, and wherein the front panel additionally includes a film covering the opening of the front panel.

17. The package system of claim 15, wherein the second bottom panel or the front panel of the enclosure door includes an enclosure door tab protruding therefrom.

18. The package system of claim 14, wherein the box insert blank is sized to be substantially similar in size to the first back panel of the enclosure base.

19. The package system of claim 14, wherein:

the box insert blank comprises at least one box insert tab;

the enclosure base further comprises at least one slot; and the at least one box insert tab is coupled to the at least one slot in the enclosure base.

20. The package system of claim 19, wherein:

the box insert blank additionally comprises a second back panel and a second top panel coupled to a top portion of the second back panel of the box insert blank;

the second top panel having a first surface and a second surface opposite the first surface;

the second top panel is folded to expose the first surface of the second top panel towards a center of the cavity when the box insert blank is fixedly attached within the enclosure base; and the second surface of the second top panel abuts the first top panel of the enclosure base.

21. The folding box of claim 5, wherein the product mounting blank further comprises a least one blank mounting tab; and the box insert blank further comprises at least one associated product mounting slot configured to receive the at least one blank mounting tab.

22. The folding box of claim 21, wherein the box insert blank additionally includes two or more mounting adhesive strips configured to adhesively secure the at least one blank mounting tab within the at least one associated product mounting slot.

* * * * *

UNITED STATES PATENT AND TRADEMARK OFFICE

CERTIFICATE OF CORRECTION

PATENT NO. : 8,181,788 B2
APPLICATION NO. : 12/713155
DATED : May 22, 2012
INVENTOR(S) : Aaron Meneses It is certified that error appears in the above-identified patent and that said Letters Patent is hereby corrected as shown below:

Column 20, Line 53, Claim 14 should read:

"[is] are configured to form a cavity to receive the two-piece product display."

Signed and Sealed this
Seventeenth Day of July, 2012

David J. Kappos

David J. Kappos
*Director of the United States Patent and Trademark Office*